US012674264B2

(12) United States Patent
Park et al.

(10) Patent No.: US 12,674,264 B2
(45) Date of Patent: Jul. 7, 2026

(54) WASHING MACHINE AND METHOD FOR CONTROLLING THE SAME

(71) Applicant: SAMSUNG ELECTRONICS CO., LTD., Suwon-si (KR)

(72) Inventors: Jongha Park, Suwon-si (KR); Gyusung Na, Suwon-si (KR); Sungjong Kim, Suwon-si (KR); Hangyeol Kim, Suwon-si (KR); Jaeyoung Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 152 days.

(21) Appl. No.: 18/799,302

(22) Filed: Aug. 9, 2024

(65) Prior Publication Data

US 2025/0075393 A1 Mar. 6, 2025

Related U.S. Application Data

(63) Continuation of application No. PCT/KR2024/095914, filed on Jul. 10, 2024.

(30) Foreign Application Priority Data

Sep. 1, 2023 (KR) ..... 10-2023-0116475

(51) Int. Cl.
*D06F 34/16* (2020.01)
*D06F 33/48* (2020.01)
(Continued)

(52) U.S. Cl.
CPC ..... *D06F 34/16* (2020.02); *D06F 33/48* (2020.02); *D06F 37/225* (2013.01); *D06F 2103/26* (2020.02)

(58) Field of Classification Search
CPC ..... D06F 34/16; D06F 37/225; D06F 33/48; D06F 2103/26
See application file for complete search history.

(56) References Cited

U.S. PATENT DOCUMENTS 6,865,947 B2 3/2005 Baek
11,255,717 B2 * 2/2022 Omote ..... G01H 1/12
(Continued)

FOREIGN PATENT DOCUMENTS

CA 2875648 A1 * 12/2013 ..... F16F 15/32
CN 115262167 A 11/2022
(Continued)

OTHER PUBLICATIONS

International Search Report dated Oct. 29, 2024 issued in PCT Application No. PCT/KR2024/095914.
(Continued)

*Primary Examiner* — Benjamin L Osterhout
(74) *Attorney, Agent, or Firm* — STAAS & HALSEY LLP

(57) ABSTRACT

A washing machine has a tub, a drum configured to be rotatable inside the tub, a weight balancer coupled to the tub, a vibration sensor configured to detect vibration of the tub while the drum is rotating, and at least one processor configured to determine whether a weight balancer is damaged based on a difference between a magnitude of the detected vibration of the tub at a fundamental frequency corresponding to a rotational speed of the drum and a magnitude of the detected vibration of the tub at a harmonic frequency of the fundamental frequency.

15 Claims, 15 Drawing Sheets

(51) Int. Cl.
*D06F 103/26* (2020.01)
*D06F 37/22* (2006.01)

(56) References Cited

U.S. PATENT DOCUMENTS

| | | | | |
|---|---|---|---|---|
| 2011/0060553 | A1* | 3/2011 | Han | H04L 12/2825 702/185 |
| 2013/0327098 | A1* | 12/2013 | Bae | D06F 33/47 74/572.4 |
| 2017/0327990 | A1 | 11/2017 | Lee et al. | |

FOREIGN PATENT DOCUMENTS

| | | | | |
|---|---|---|---|---|
| EP | 2671995 | A1 * | 12/2013 | D06F 37/225 |
| EP | 3628767 | A1 * | 4/2020 | D06F 37/304 |
| JP | 2004-344338 | | 12/2004 | |
| JP | 4941319 | | 5/2012 | |
| JP | 2012143513 | A * | 8/2012 | |
| KR | 2000-0056415 | | 9/2000 | |
| KR | 10-2001-0039503 | | 5/2001 | |
| KR | 20040000865 | A * | 1/2004 | D06F 58/52 |
| KR | 10-0741810 | | 7/2007 | |
| KR | 10-0802468 | | 2/2008 | |
| KR | 10-2008-0037416 | | 4/2008 | |
| KR | 10-2011-0132983 | | 12/2011 | |
| KR | 101407959 | B1 * | 6/2014 | D06F 37/225 |
| KR | 10-2017-0127756 | | 11/2017 | |
| KR | 10-2020-0030251 | | 3/2020 | |
| KR | 10-2219422 | | 2/2021 | |

OTHER PUBLICATIONS

Written Opinion dated Oct. 29, 2024 issued in PCT Application No. PCT/KR2024/095914.

* cited by examiner

WASHING MACHINE AND METHOD FOR CONTROLLING THE SAME

CROSS REFERENCE TO THE RELATED APPLICATION

This application is a continuation application, filed under 35 U.S.C. § 111(a), of International Application PCT/KR2024/095914 filed Jul. 10, 2024, and is based on and claims priority under 35 U.S.C. § 119 to Korean Patent Applications No. 10-2023-0116475, filed on Sep. 1, 2023 in the Korean Intellectual Property Office, the disclosures of which are incorporated by reference herein in their entireties.

TECHNICAL FIELD

The disclosure relates to a washing machine and a method for controlling the same.

BACKGROUND ART

In general, a washing machine may include a tub and a drum rotatably installed in the tub, and may wash laundry by rotating the drum containing laundry in the tub. The washing machine may perform a washing process of laundry, a rinsing process of the washed laundry, and a spin-drying process of the rinsed laundry.

In the spin-drying process, water absorbed in the laundry may be separated from the laundry by accelerating the drum containing the laundry at high speed.

Accelerating the drum at high speed may cause severe vibration and noise in the tub for various reasons, and may even damage the washing machine.

In particular, in the event of damage to a weight balancer that prevents weight imbalance of the tub, abnormal vibrations and noises may occur in the tub, which may cause anxiety to users.

DISCLOSURE

Technical Solution

An aspect of the disclosure provides a washing machine and a method for controlling the same that may easily identify whether a weight balancer is damaged.

An aspect of the disclosure provides a washing machine and a method for controlling the same that may confirm whether abnormal vibration of a tub is caused by a damaged weight balancer.

An aspect of the disclosure provides a washing machine and a method for controlling the same that may allow a user to take proactive measures before damage to a weight balancer worsens.

An aspect of the disclosure provides a washing machine and a method for controlling the same that may determine whether a weight balancer is damaged using only a vibration sensor, without any other sensor such as a microphone, and the like.

Technical objects that may be achieved by the disclosure are not limited to the above-mentioned objects, and other technical objects not mentioned will be clearly understood by one of ordinary skill in the art to which the disclosure belongs from the following description.

According to an embodiment of the disclosure, a washing machine may include: a tub; a drum configured to be rotatable inside the tub; a weight balancer configured to be coupled to the tub; a vibration sensor configured to detect vibration of the tub while the drum is rotating; and at least one processor configured to determine whether the weight balancer is damaged based on a difference between a magnitude of the detected vibration at a fundamental frequency corresponding to a rotational speed of the drum and a magnitude of the detected vibration at a harmonic frequency of the fundamental frequency.

According to an embodiment of the disclosure, a method for controlling a washing machine, including a tub, a drum configured to be rotatable inside the tub, a weight balancer coupled to the tub, and a vibration sensor configured to detect vibration of a tub, may include: detecting vibration of the tub by the vibration sensor while the drum is rotating, determining whether the weight balancer is damaged, based on a difference between a magnitude of the detected vibration at a fundamental frequency corresponding to a rotational speed of the drum and a magnitude of the detected vibration at a harmonic frequency of the fundamental frequency.

The determining of whether the weight balancer is damaged comprises determining that the weight balancer is damaged based on the difference between the magnitude of the vibration at the fundamental frequency and the magnitude of the vibration at the harmonic frequency being less than a predetermined value.

The determining of whether the weight balancer is damaged is performed based on the rotational speed of the drum reaching a predetermined rotational speed.

The predetermined rotational speed corresponds to a maximum rotational speed in a spin-drying process.

The determining of whether the weight balancer is damaged is performed based on a vibration value corresponding to the vibration of the tub exceeding a threshold value.

MODES OF THE DISCLOSURE

Figure 1:
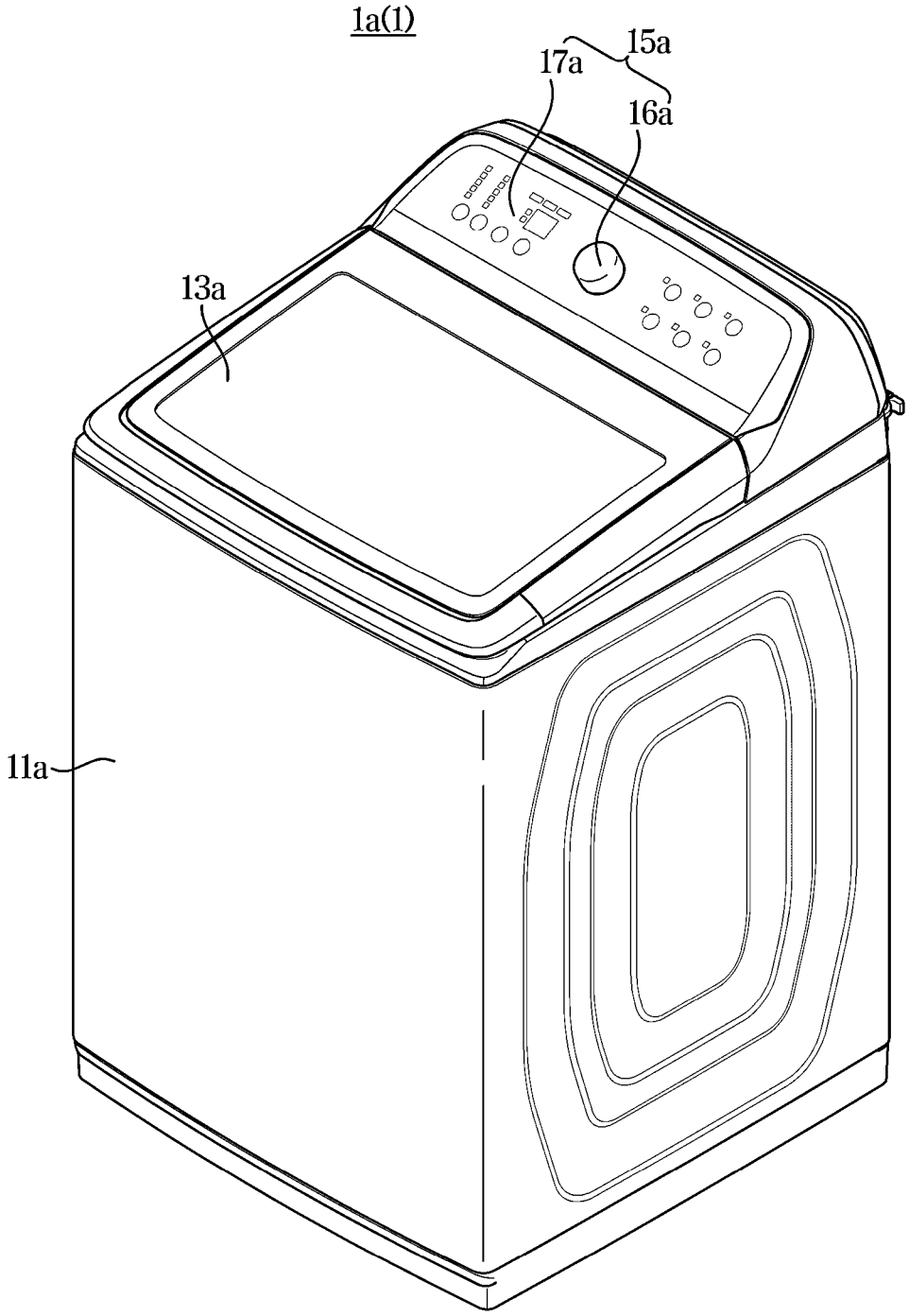
FIG. 1 illustrates an example of an exterior of a washing machine according to an embodiment.

Embodiments described in the specification and configurations shown in the accompanying drawings are merely examples of the disclosure, and various modifications may replace the embodiments and the drawings of the disclosure at the time of filing of the application.

Like reference numerals or symbols denoted in the drawings of the specification are members or components that perform the substantially same functions.

A singular form of a noun corresponding to an item may include one item or a plurality of the items, unless context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

The term "and/or" includes any and all combinations of one or more of a plurality of associated listed items.

It will be understood that the terms "first", "second", or the like, may be used only to distinguish one component from another, not intended to limit the corresponding component in other aspects (e.g., importance or order).

When it is said that one (e.g., first) component is "coupled" or "connected" to another (e.g., second) component, with or without the terms "functionally" or "communicatively", it means that one component may be connected to the other component directly (e.g., by wire), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component.

It will also be understood that when one component is referred to as being "on" or "over" another component, it may be directly on the other component or intervening components may also be present.

A washing machine according to various embodiments may perform washing, rinsing, spin-drying, and drying processes. The washing machine is an example of a clothes care apparatus, and the clothes care apparatus is a concept including a device capable of washing clothes (objects to be washed, and objects to be dried), a device capable of drying clothes, and a device capable of washing and drying clothes.

The washing machine according to various embodiments may include a top-loading washing machine in which a laundry inlet for inserting or withdrawing laundry is provided to face upward, or a front-loading washing machine in which a laundry inlet is provided to face forward.

The washing machine according to various embodiments may include a washing machine that is in a loading type other than the top-loading washing machine and the front-loading washing machine.

In the top-loading washing machine, laundry may be washed using water current generated by a rotating body such as a pulsator. In the front-loading washing machine, laundry may be washed by repeatedly lifting and lowering laundry by rotating a drum. The front-loading washing machine may include a dryer combined washing machine capable of drying laundry stored in a drum. The dryer combined washing machine may include a hot air supply device for supplying high-temperature air into the drum and a condensing device for removing moisture from air discharged from the drum. For example, the dryer combined washing machine may include a heat pump device. The washing machine according to various embodiments may include a washing machine using a washing method other than the above-described washing method.

The washing machine according to various embodiments may include a housing accommodating various components therein. The housing may be in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be seen.

The washing machine may include a tub arranged inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub in such a way that a drum opening provided at one side of the drum corresponds to the laundry inlet and the tub opening. Laundry may pass through the laundry inlet, the tub opening, and the drum opening, sequentially and then be accommodated in the drum or withdrawn from the drum.

The drum may perform washing, rinsing, and/or spin-drying, while rotating inside the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply device configured to supply water to the tub. The water supply device may include a water supply pipe and a water supply valve disposed in the water supply pipe. The water supply pipe may be connected to an external water supply source. The water supply pipe may extend from an external water supply source to a detergent supply device and/or the tub. Water may be supplied to the tub through the detergent supply device. Alternatively, water may be supplied to the tub without passing through the detergent supply device.

The water supply valve may open or close the water supply pipe in response to an electrical signal of a controller. The water supply valve may allow or block the supply of water to the tub from an external water supply source. The water supply valve may include, for example, a solenoid valve configured to open and close in response to an electrical signal.

The washing machine may include the detergent supply device configured to supply detergent to the tub. The detergent supply device may include a manual detergent supply device that requires a user to input detergent to be used for each washing, and an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with detergent via the detergent supply device. Water mixed with detergent may be supplied into the tub. The term "detergent" may include, for example, detergent for pre-washing, detergent for main washing, fabric softener, bleach, and the like. The detergent box may be partitioned into a storage region for the pre-washing detergent, a storage region for the main washing detergent, a storage region for the fabric softener, and a storage region for the bleach.

The washing machine may include a drainage device configured to discharge water contained in the tub to the outside. The drainage device may include a drain pipe extending from a bottom of the tub to the outside of the housing, a drain valve disposed on the drain pipe to open and close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include, for example, a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output through a screen, an indicator, or voice. The at least one output interface may include a Liquid Crystal Display (LCD) panel, a Light Emitting Diode (LED) panel, or a speaker.

The washing machine may include a communication module for wired and/or wireless communication with an external device.

The communication module may include at least one of a short-range wireless communication module or a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to an embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, or a server on a mobile communication network.

According to an embodiment, the communication module may communicate with an external device such as a server, a user device and other home appliances through an access point (AP). The access point (AP) may connect a local area network (LAN), to which a washing machine or a user device is connected, to a wide area network (WAN) to which a server is connected. The washing machine or the user device may be connected to the server through the wide area network (WAN). The controller may control various components of the washing machine (e.g., the drive motor, and the water supply valve). The controller may control various components of the washing machine to perform at least one operation including water supply, washing, rinsing, and/or spin-drying according to a user input. For example, the controller may control the drive motor to adjust the rotational speed of the drum or control the water supply valve of the water supply device to supply water to the tub.

The controller may include hardware such as a CPU or memory, and software such as a control program. For example, the controller may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter, a washing machine according to various embodiments of the disclosure will be described in detail with reference to the accompanying drawings.

Figure 4:
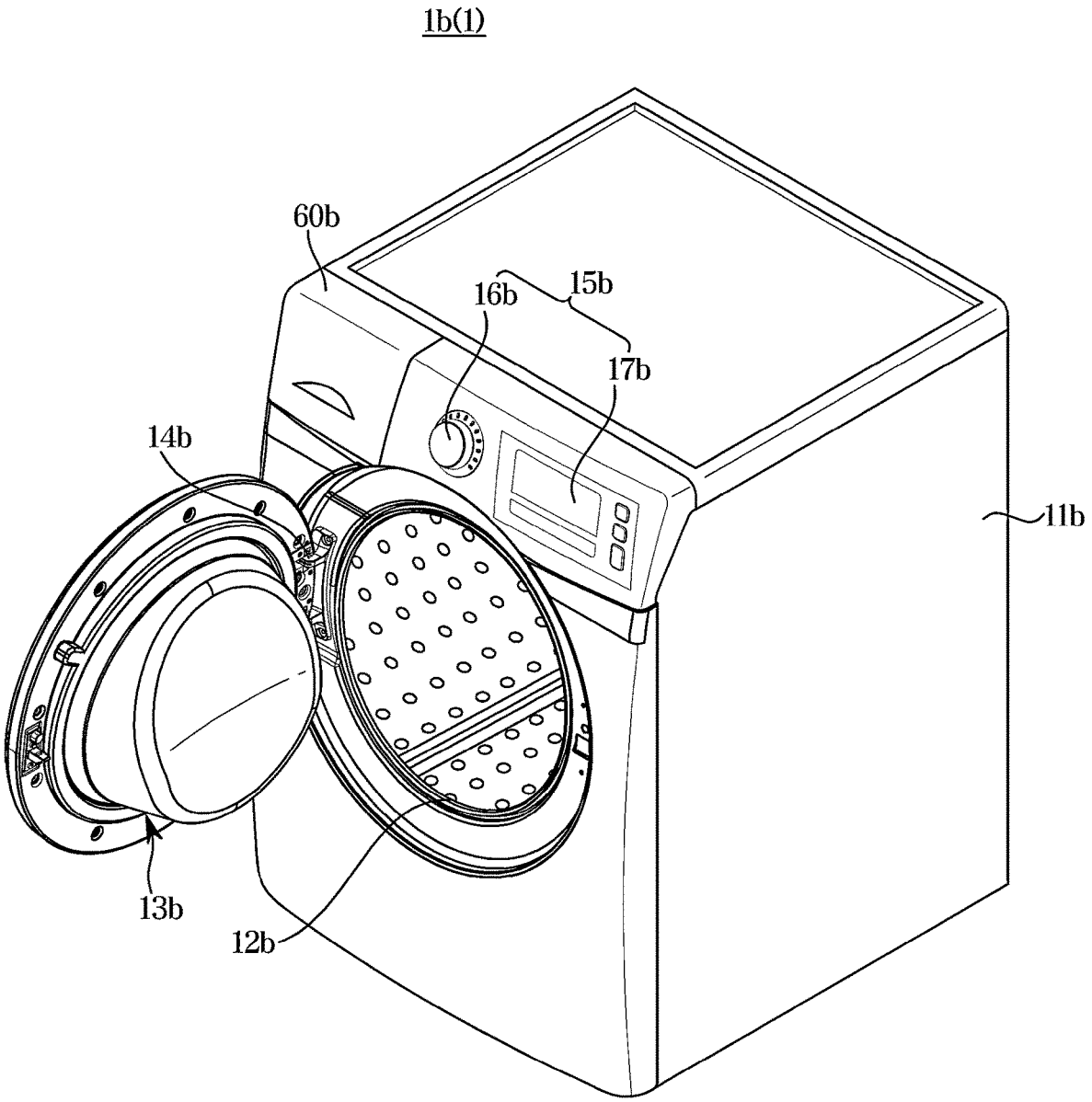
FIG. 4 illustrates an example of an exterior of a washing machine according to an embodiment.
Figure 5:
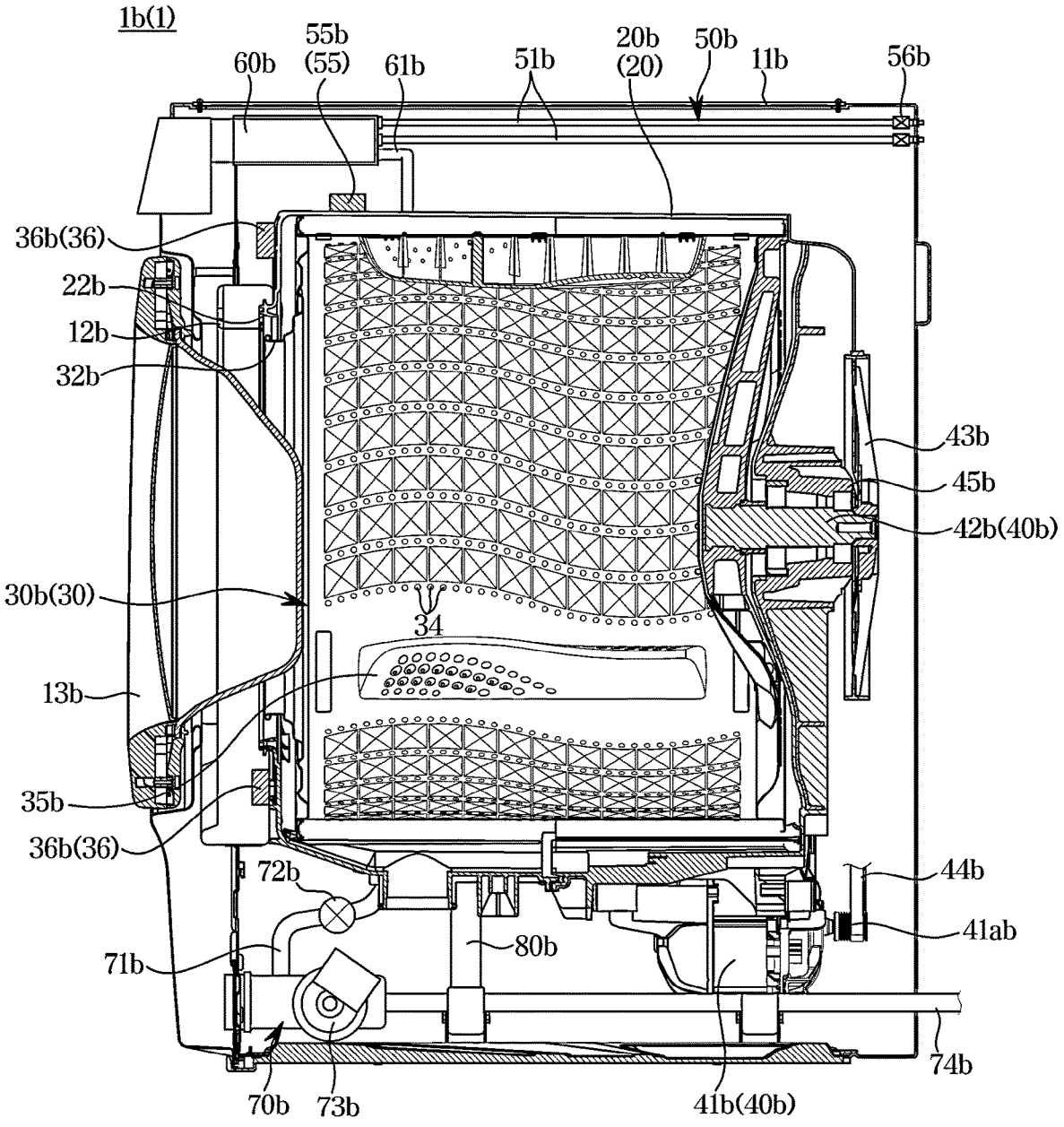
FIG. 5 is a cross-sectional view of the washing machine shown in FIG. 4.

A washing machine 1 according to an embodiment may be a top-loading washing machine 1*a* (see FIG. 1 and FIG. 2) or a front-loading washing machine 1*b* (see FIG. 4 and FIG. 5).

Figure 2:
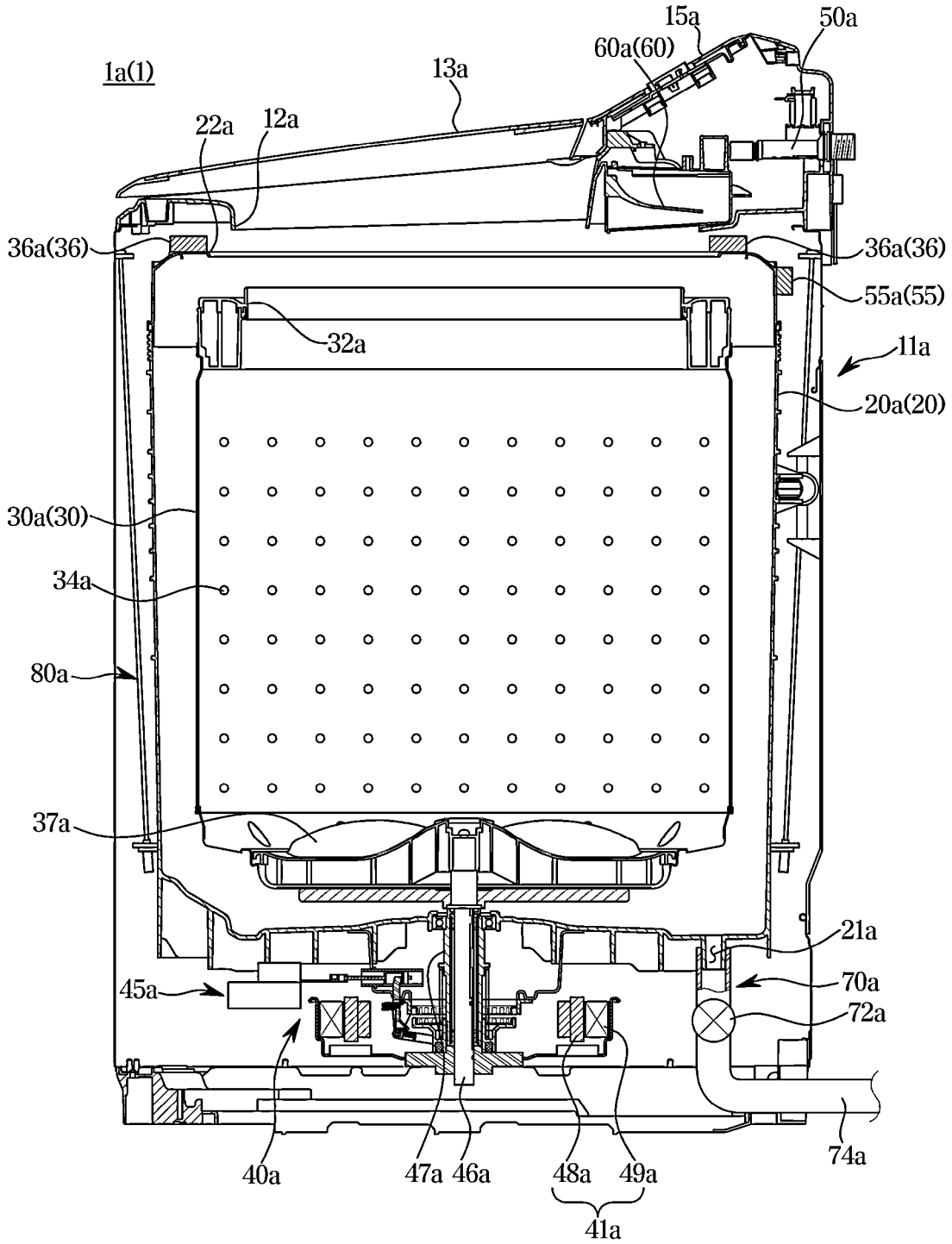
FIG. 2 is a cross-sectional view of the washing machine shown in FIG. 1.

FIG. 1 illustrates an example of an exterior of a washing machine according to an embodiment. FIG. 2 is a cross-sectional view of the washing machine shown in FIG. 1.

Referring to FIG. 1 and FIG. 2, the washing machine 1*a* may include a housing 11*a* for accommodating various components therein. The housing 11*a* may form an exterior of the washing machine 1*a*. The housing 11*a* may be in the form of a box with one side open.

The housing 11*a* may include a housing opening 12*a* formed to provide access to the inside of a drum 30*a*. The housing opening 12*a* may be opened substantially upwards.

The washing machine 1*a* may include a door 13*a* for opening and closing the housing opening 12*a* formed in the housing 11*a*. The door 13*a* may be rotatably mounted to the housing 11*a* by a hinge. At least a portion of the door 13*a* may be transparent or translucent to allow the inside of the housing to be seen.

The washing machine 1*a* may include a tub 20*a* located inside the housing 11*a* to store water. The tub 20*a* may be disposed in the housing 11*a*. The tub 20*a* may include a tub opening 22*a* formed to correspond to the housing opening 12*a*. The tub opening 22*a* may be opened substantially upwards. The tub 20*a* may be supported inside the housing 11*a*. The tub 20*a* may have a substantially cylindrical shape with one side open.

The tub 20*a* may be elastically supported from the housing 11*a* by a damper 80*a*. The damper 80*a* may connect the housing 11*a* and the tub 20*a*. The damper 80*a* may attenuate vibrations generated during rotation of the drum 30*a* by absorbing the vibration energy between the tub 20*a* and the housing 11*a* upon transferring of the vibrations to the tub 20*a* and/or the housing 11*a*.

The tub 20*a* may be provided with a vibration sensor 55*a* for detecting vibration of the tub 20*a*. The vibration sensor 55*a* may be disposed at a location capable of detecting vibration of the tub 20*a*.

A weight balancer 36*a* may be coupled to the tub 20*a* to prevent weight imbalance of the tub 20*a*. For example, the weight balancer 36*a* may be coupled to an upper side of the tub 20*a*.

The weight balancer 36*a* may include a housing (e.g., injection molded plastic) and a filling member (e.g., cement/concrete) filled in the housing. A member having a suitable weight to prevent weight imbalance of the tub 20*a* may be selected as the filling member.

The washing machine 1*a* may include a drum 30*a* to accommodate laundry. The drum 30*a* may be rotatably disposed inside the tub 20*a*. The drum 30*a* may perform washing, rinsing, and/or spin-drying, while rotating inside the tub 20*a*. The drum 30*a* may include a plurality of through holes 34*a* connecting an inner space of the drum 30*a* and an inner space of the tub 20*a*. The drum 30*a* may have a substantially cylindrical shape with one side open.

A pulsator 37*a* may be rotatably disposed at a lower portion of the drum 30*a*, and may generate water current (wash water stream). The laundry may be washed by the water current generated by the pulsator 37*a*.

The drum 30*a* may include a drum opening 32*a* formed to correspond to the housing opening 12*a* and the tub opening 22*a*. The laundry may be accommodated in the drum 30*a* or withdrawn from the drum 30*a* through the housing opening 12*a*, the tub opening 22*a*, and the drum opening 32*a*.

The washing machine 1*a* may include a driving device 40*a* configured to rotate the drum 30*a* and the pulsator 37*a*. The driving device 40*a* may include a motor 41*a* and a shaft system for transferring a driving force generated by the motor 41*a* to the drum 30*a* and the pulsator 37*a*.

The motor 41*a* may include a fixed stator 48*a*, and a rotor 49*a* that electromagnetically interacts with the stator 48*a* to rotate.

The shaft system may include a spin-drying shaft 47*a* for transferring the driving force of the motor 41*a* to the drum 30*a*, a washing shaft 46*a* for transferring the driving force of the motor 41*a* to the pulsator 37*a*, and a clutch device 45*a* for connecting or disconnecting between the motor 41*a* and the spin-drying shaft 47*a*.

The spin-drying shaft 47*a* may have a hollow, and the washing shaft 46*a* may be provided in the hollow of the spin-drying shaft 47*a*. The washing shaft 46*a* may keep connected to the rotor 49*a* of the motor 41*a*, and the spin-drying shaft 47*a* may be connected to or disconnected from the rotor 49*a* of the motor 41*a* by the clutch device 45*a*.

In a case where the clutch device 45*a* disconnects the spin-drying shaft 47*a* from the motor 41*a*, power is transmitted only to the washing shaft 46*a* to rotate only the pulsator 37*a*. In a case where the clutch device 45*a* connects the spin-drying shaft 47*a* and the motor 41*a*, power is transmitted to both the spin-drying shaft 47*a* and the washing shaft 46*a*, allowing the drum 30*a* and the pulsator 37*a* to rotate simultaneously.

In a case where only the pulsator 37*a* rotates, a wash water current may be generated by the rotation of the pulsator 37*a*, the laundry may be washed by friction with the drum 30*a* while the laundry rotates due to the generated wash water current. In a case where both the pulsator 37*a* and the drum 30*a* rotate simultaneously, moisture may be removed from the laundry by centrifugal force generated while the laundry in the drum 30*a* rotates, allowing the laundry to be spin-dried.

The washing machine 1*a* may include a water supply device 50*a* to supply water to the tub 20*a*. The water supply device 50*a* may be disposed above the tub 20*a*. The water supply device 50*a* may include a water supply pipe, and a water supply valve arranged on the water supply pipe. The water supply pipe may be connected to an external water supply source. The water supply pipe may extend from the external water supply source to a detergent supply device 60*a* and/or the tub 20*a*. Water may be supplied to the tub 20*a* through the detergent supply device 60*a*. Water may be supplied to the tub 20*a* without passing through the detergent supply device 60*a*.

The water supply valve may open or close the water supply pipe in response to an electrical signal. The water supply valve may allow or block the supply of water to the tub 20*a* from an external water supply source. For example, the water supply valve may include a solenoid valve configured to be open and closed in response to an electrical signal.

The washing machine 1*a* may include the detergent supply devices 60*a* to supply detergent to the tub 20*a*. The detergent supply device 60*a* may be configured to supply detergent into the tub 20*a* during a water supply process. Water supplied through the water supply pipe may be mixed with detergent via the detergent supply device 60*a*. Water mixed with detergent may be supplied into the tub 20*a*. The term "detergent" may include, for example, laundry detergent, rinse for dryer, deodorant, sanitizer, fabric softener, bleach, and the like.

The washing machine 1*a* may include a drainage device 70*a* to discharge water contained in the tub 20*a* to the outside. A drain 21*a* may be formed in a lower portion of the tub 20*a* to drain water stored in the tub 20*a* to the outside of the tub 20*a*. A drain hose 74*a* may be connected to the drain 21*a*, and a drain valve 72*a* may be provided in the drain hose 74*a* to open and close the drain hose 74*a*.

The washing machine 1*a* may include a user interface device 15*a* for interaction between a user and the washing machine 1*a*.

The washing machine 1*a* may include at least one user interface device 15*a*. The user interface device 15*a* may include at least one input interface 16*a* and at least one output interface 17*a*.

The at least one input interface 16*a* may convert sensory information received from a user into an electrical signal.

The at least one input interface 16*a* may include a power button, an operation button, a course selection dial (or a course selection button), and a washing/rinsing/spin-drying setting button. The at least one input interface 16*a* may include, for example, a tact switch, a push switch, a slide switch, a toggle switch, a micro switch, a touch switch, a touch pad, a touch screen, a jog dial, and/or a microphone.

The at least one output interface 17*a* may generate sensory information and convey various information related to operations of the washing machine 1*a* to a user.

For example, the at least one output interface 17*a* may convey information related to a washing course, operation time of the washing machine 1*a*, and washing/rinsing/spin-drying settings to the user. Information about the operation of the washing machine 1*a* may be output through a screen, an indicator, voice, or the like. The at least one output interface 17*a* may include, for example, a Liquid Crystal Display (LCD) panel, a Light Emitting Diode (LED) panel, or a speaker.

Figure 3:
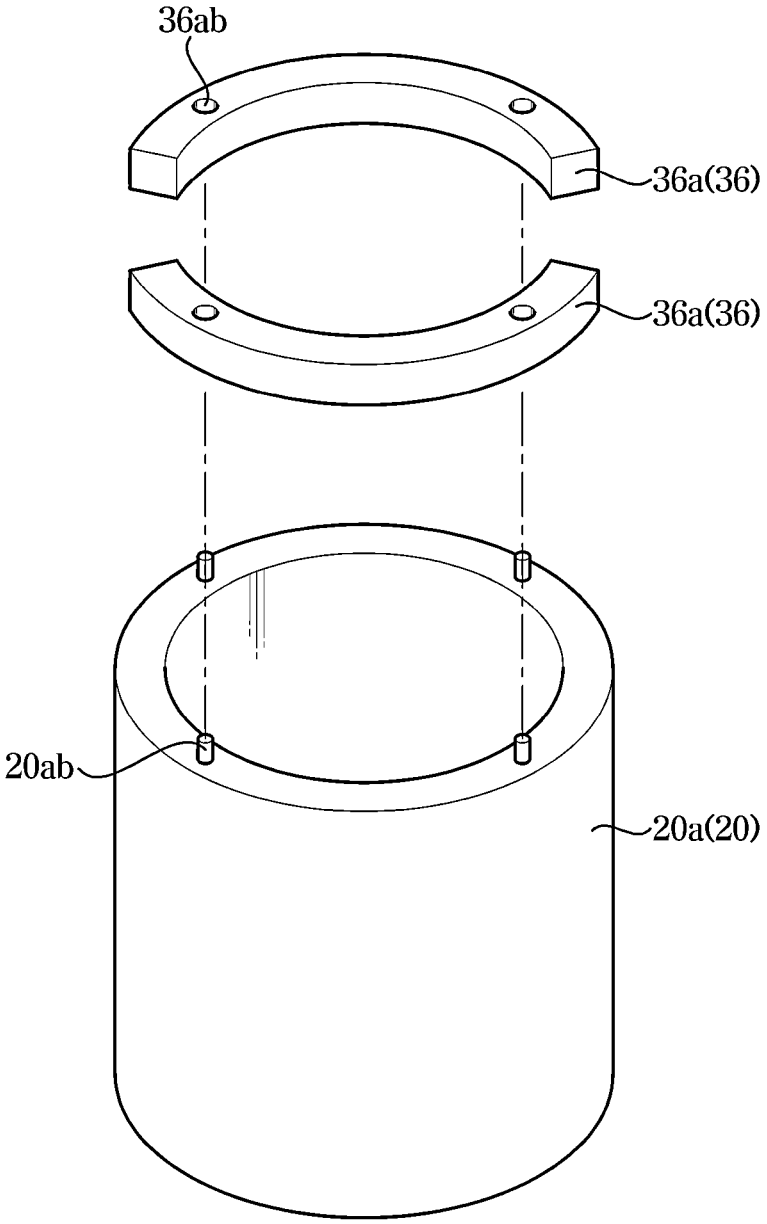
FIG. 3 is a view illustrating a weight balancer of the washing machine shown in FIG. 1.

FIG. 3 is a view illustrating a weight balancer of the washing machine shown in FIG. 1.

Referring to FIG. 3, the tub 20*a* may include a fixing protrusion 20*ab*. For example, a plurality of fixing protrusions 20*ab* may be formed on an upper side of the tub 20*a*. The plurality of fixing protrusions 20*ab* may be fastening bolts.

The weight balancer 36*a* may include fastening holes 36*ab*. By inserting the plurality of fixing protrusions 20*ab* formed on the tub 20*a* into the fastening holes 36*ab* formed on the weight balancer 36*a*, the weight balancer 36*a* may be coupled to the tub 20*a* using a nut.

A method by which the weight balancer 36*a* is coupled to the tub 20*a* is not limited thereto, and various fastening methods may be used. For example, a fixing protrusion may be provided on the weight balancer 36*a*, and a fastening hole may be provided on the tub 20*a*.

The weight balancer 36*a* may increase a weight of the tub 20*a* by being coupled to the tub 20*a*.

FIG. 4 illustrates an example of an exterior of a washing machine according to an embodiment. FIG. 5 is a cross-sectional view of the washing machine shown in FIG. 4.

Referring to FIG. 4 and FIG. 5, the washing machine 1*b* may include a washing machine housing 11*b* for accommodating various components therein. The washing machine housing 11*b* may form an exterior of the washing machine 1*b*. The washing machine housing 11*b* may be in the form of a box with one side open.

The washing machine housing 11*b* may include a housing opening 12*b* formed to provide access to the inside of a drum 30*b*. The housing opening 12*b* may be opened substantially to the front.

The washing machine 1*b* may include a door 13*b* for opening and closing the housing opening 12*b* formed in the washing machine housing 11*b*. The door 13*b* may be rotatably mounted to the washing machine housing 11*b* by a hinge 14*b*. At least a portion of the door 13*b* may be transparent or translucent to allow the inside of the washing machine housing 11*b* to be seen.

The washing machine 1*b* may include a tub 20*b* located inside the washing machine housing 11*b* to store water. The tub 20*b* may be disposed in the washing machine housing 11*b*. The tub 20*b* may include a tub opening 22*b* formed to correspond to the housing opening 12*b*. The tub opening 22*b* may be opened substantially to the front. The tub 20*b* may be supported inside the washing machine housing 11*b*. The tub 20*b* may have a substantially cylindrical shape with one side open.

The tub 20*b* may be elastically supported from the washing machine housing 11*b* by a damper 80*b*. The damper 80*b* may connect the washing machine housing 11*b* and the tub 20*b*. The damper 80*b* may attenuate vibrations generated during rotation of the drum 30*b* by absorbing the vibration energy between the tub 20*b* and the washing machine housing 11*b* upon transferring of the vibrations to the tub 20*b* and/or the washing machine housing 11*b*.

The tub 20*b* may be provided with a vibration sensor 55*b* for detecting vibration of the tub 20*b*. The vibration sensor 55*b* may be disposed at a location capable of detecting vibration of the tub 20*b*.

A weight balancer 36*b* may be coupled to the tub 20*b* to prevent weight imbalance of the tub 20*b*. For example, the weight balancer 36*b* may be coupled to a front side of the tub 20*b*.

The weight balancer 36*b* may include a housing (e.g., injection molded plastic) and a filling member (e.g., cement/concrete) filled in the housing. A member having a suitable weight to prevent weight imbalance of the tub 20*b* may be selected as the filling member.

The washing machine 1*b* may include a drum 30*b* to accommodate laundry. The drum 30*b* may be rotatably disposed inside the tub 20*b*. The drum 30*b* may perform washing, rinsing, and/or spin-drying, while rotating inside the tub 20*b*. The drum 30*b* may include a plurality of through holes 34*b* connecting an inner space of the drum 30*b* and an inner space of the tub 20*b*. The drum 30*b* may have a substantially cylindrical shape with one side open. At least one lifter 35*b* may be installed on an inner circumference of the drum 30*b* to lift and drop laundry during rotation of the drum 30*b*.

The drum 30*b* may include a drum opening 32*b* formed to correspond to the housing opening 12*b* and the tub opening 22*b*. The laundry may be accommodated in the drum 30*b* or withdrawn from the drum 30*b* through the housing opening 12*b*, the tub opening 22*b*, and the drum opening 32*b*.

The washing machine 1*b* may include a driving device 40*b* configured to rotate the drum 30*b*. The driving device 40*b* may include a motor 41*b* and a rotating shaft 42*b* for transmitting a driving force generated by the motor 41*b* to the drum 30*b*. The rotating shaft 42*b* may penetrate the tub 20*b* and be connected to the drum 30*b*.

The washing machine 1*b* may be divided into a direct driving type in which the rotating shaft 42*b* is directly connected with the motor 41*b* to rotate the drum 30*b*, and an indirect driving type in which a pulley 43*b* is connected between the motor 41*b* and the rotating shaft 42*b* to drive the drum 30*b*.

The washing machine 1*b* according to an embodiment may be a washing machine of the indirect driving type, without being limited thereto. That is, the washing machine 1*b* according to an embodiment may be a washing machine of the direct driving type.

One end of the rotating shaft 42*b* may be connected to the drum 30, and the other end of the rotating shaft 42*b* may be connected to the pulley 43*b* to receive a driving force from the motor 41*b*. A motor pulley 41*ab* may be formed on a rotating shaft of the motor 41*b*. A driving belt 44*b* may be provided between the motor pulley 41*ab* and the pulley 43*b*, and the rotating shaft 42*b* may be driven by the driving belt 44*b*.

In the rear portion of the tub 20*b*, a bearing housing 45*b* for rotatably supporting the rotating shaft 42*b* may be installed. The bearing housing 45*b* may be made of an aluminum alloy. The bearing housing 45*b* may be inserted into the rear portion of the tub 20*b* upon injection-molding of the tub 20*b*.

The driving device 40*b* may rotate the drum 30*b* forward or backward to perform washing, rinsing, and/or spin-drying, or drying operations.

The washing machine 1*b* may include a water supply device 50*b* to supply water to the tub 20*b*. The water supply device 50*b* may be disposed above the tub 20*b*. The water supply device 50*b* may include a water supply pipe 51*b*, and a water supply valve 56*a* arranged on the water supply pipe 51*b*. The water supply pipe 51*b* may be connected to an external water supply source. The water supply pipe 51*b* may extend from the external water supply source to a detergent supply device 60*b* and/or the tub 20*b*. Water may be supplied to the tub 20*b* through the detergent supply device 60*b*. Water may be supplied to the tub 20*b* without passing through the detergent supply device 60*b*.

The water supply valve 56*b* may open or close the water supply pipe 51*b* in response to an electrical signal. The water supply valve 56*b* may allow or block the supply of water to the tub 20*b* from an external water supply source. For example, the water supply valve 56*b* may include a solenoid valve configured to be open and closed in response to an electrical signal.

The washing machine 1*b* may include the detergent supply devices 60*b* to supply detergent to the tub 20*b*. The detergent supply device 60*b* may be configured to supply detergent to the tub 20*b* during a water supply process. Water supplied through the water supply pipe 51*b* may be mixed with detergent via the detergent supply device 60*b*. Water mixed with detergent may be supplied into the tub 20*b*. The term "detergent" may include, for example, laundry detergent, rinse for dryer, deodorant, sanitizer, fabric softener, bleach, and the like. The detergent supply device 60*b* may be connected to the tub 20*b* through a connection pipe 61*b*.

The washing machine 1*b* may include a drainage device 70*b* to discharge water contained in the tub 20*b* to the outside. The drainage device 70*b* may include a drain pump 73*b* for discharging water from the tub 20*b* to the outside of the washing machine housing 11*b*, a connection hose 71*b* for connecting the tub 20*b* and the drain pump 73*b* to allow water in the tub 20*b* to flow into the drain pump 73*b*, and a drain hose 74*b* for guiding the water pumped by the drain pump 73*b* to the outside of the washing machine housing 11*b*. The drainage device 70*b* may include a drain valve 72*b* arranged on the connection hose 71*b* to open and close the connection hose 71*b*.

The washing machine 1*b* may include a user interface device 15*b* for interaction between a user and the washing machine 1*b*.

The washing machine 1*b* may include at least one user interface device 15*b*. The user interface device 15*b* may include at least one input interface 16*b* and at least one output interface 17*b*.

The at least one input interface 16*b* may convert sensory information received from a user into an electrical signal.

The at least one input interface 16*b* may include a power button, an operation button, a course selection dial (or a course selection button), and a washing/rinsing/spin-drying setting button. The at least one input interface 16*b* may include, for example, a tact switch, a push switch, a slide switch, a toggle switch, a micro switch, a touch switch, a touch pad, a touch screen, a jog dial, and/or a microphone.

The at least one output interface 17*b* may generate sensory information and convey various information related to operations of the washing machine 1*b* to a user.

For example, the at least one output interface 17*b* may convey information related to a washing course, operation time of the washing machine 1*b*, and washing/rinsing/spin-drying settings to the user. Information about the operation of the washing machine 1*b* may be output through a screen, an indicator, voice, or the like. The at least one output interface 17*b* may include, for example, a Liquid Crystal Display (LCD) panel, a Light Emitting Diode (LED) panel, or a speaker.

Figure 6:
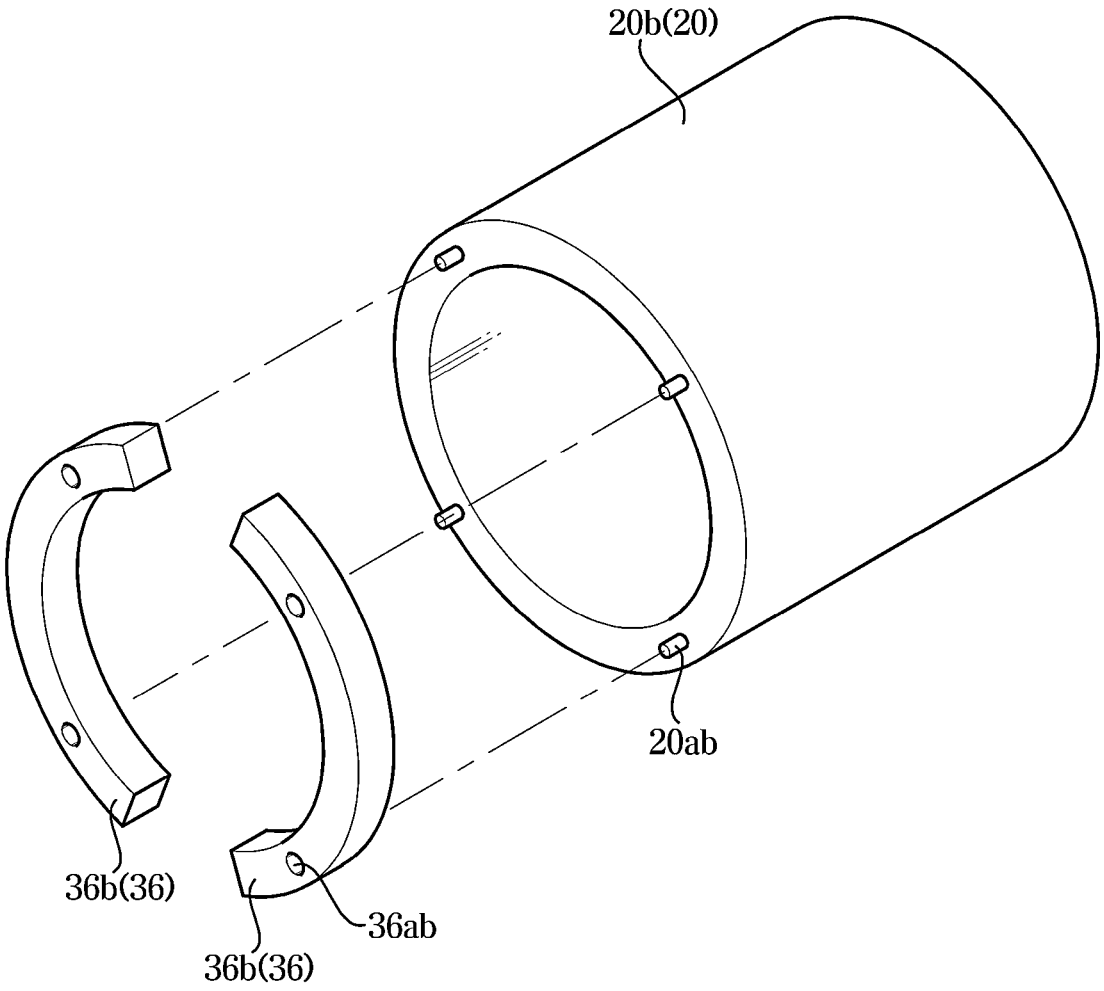
FIG. 6 is a view illustrating a weight balancer of the washing machine shown in FIG. 4.

FIG. 6 is a view illustrating a weight balancer of the washing machine shown in FIG. 4.

Referring to FIG. 6, the tub 20*b* may include the fixing protrusion 20*ab*. For example, a plurality of fixing protrusions 20*ab* may be formed on a front of the tub 20*b*. The plurality of fixing protrusions 20*ab* may be fastening bolts.

The weight balancer 36*b* may include the fastening holes 36*ab*. By inserting the plurality of fixing protrusions 20*ab* formed on the tub 20*b* into the fastening holes 36*ab* formed on the weight balancer 36*b*, the weight balancer 36*b* may be coupled to the tub 20*b* using a nut.

A method by which the weight balancer 36*b* is coupled to the tub 20*b* is not limited thereto, and various fastening methods may be used. For example, a fixing protrusion may be provided on the weight balancer 36*b*, and a fastening hole may be provided on the tub 20*b*.

The weight balancer 36*b* may increase a weight of the tub 20*b* by being coupled to the tub 20*b*.

Figure 7:
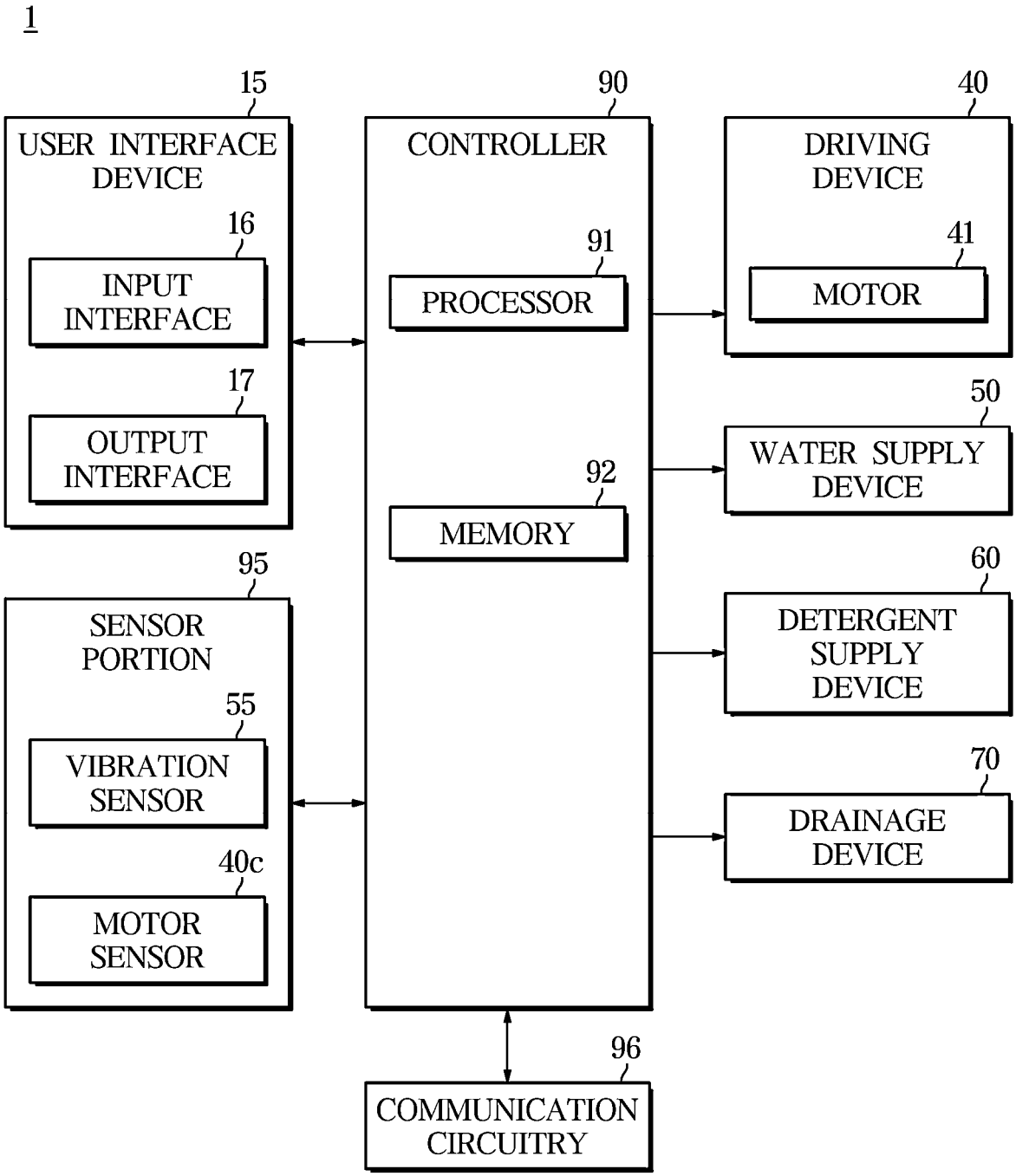
FIG. 7 is a control block diagram of an example of a washing machine according to an embodiment.

FIG. 7 is a control block diagram of an example of a washing machine according to an embodiment.

Referring to FIG. 7, in one embodiment, the washing machine 1 may include the user interface device (15; 15*a*, 15*b*), the driving device (40; 40*a*, 40*b*), the water supply device (50; 50*a*, 50*b*), the detergent supply device (60; 60*a*, 60*b*), the drainage device (70; 70*a*, 70*b*), a sensor portion 95, a communication circuitry 96, and/or a controller 90.

The user interface device 15 may provide a user interface for interaction between a user and the washing machine 1.

The user interface device 15 may include the at least one input interface (16; 16*a*, 16*b*) and the at least one output interface (17; 17*a*, 17*b*).

The at least one input interface 16 may convert sensory information received from the user into an electrical signal.

The at least one input interface 16 may include a power button, an operation button, a course selection dial (or course selection button), and a washing/rinsing/spin-drying setting button. The at least one input interface 16 may include, for example, a tact switch, a push switch, a slide switch, a toggle switch, a micro switch, a touch switch, a touch pad, a touch screen, a jog dial, and/or a microphone, and the like.

The at least one output interface 17 may generate sensory information and convey various information related to operations of the washing machine 1 to the user.

For example, the at least one output interface 17 may convey information related to a washing course, operation time of the washing machine, and washing/rinsing/spin-drying settings to the user. Information about the operation of the washing machine 1 may be output through a screen, an indicator, voice, or the like. The at least one output interface 17 may include, for example, a Liquid Crystal Display (LCD) panel, a Light Emitting Diode (LED) panel, or a speaker.

The driving device (40; 40*a*, 40*b*) may include the motor (41; 41*a*, 41*b*) that provides a driving force to rotate the drum (30; 30*a*, 30*b*), and a driving circuit that drives the motor 41. The motor 41 may operate based on a driving current supplied from the driving circuit. The driving device 40 may operate based on a control signal from the controller 90.

The water supply device (50; 50*a*, 50*b*) may include the water supply valve (56*a*, 56*b*) that may open and close the water supply pipe (51*a*, 51*b*) extending from an external water source to the detergent supply device (60; 60*a*, 60*b*) and/or the tub (20; 20*a*, 20*b*). The water supply valve (56*a*, 56*b*) may be opened or closed based on a control signal from the controller 90.

The detergent supply device (60; 60*a*, 60*b*) may supply detergent into the tub 20 during a water supply process.

The drainage device (70; 70*a*, 70*b*) may include the drain pump (73*a*, 73*b*) for discharging water in the tub 20 to the outside of the washing machine housing (11*a*, 11*b*). The drain pump (73*a*, 73*b*) may operate based on a control signal from the controller 90.

The sensor portion 95 may include at least one sensor for obtaining information related to an operation state of the washing machine 1. The sensor portion 95 may transmit sensor data collected by the at least one sensor to the controller 90.

In one embodiment, the sensor portion 95 may include the vibration sensor (55; 55*a*, 55*b*) that detects vibration of the tub 20.

The vibration sensor 55 may detect the vibration of the tub 20. The vibration sensor 55 may be an acceleration sensor (e.g., microelectromechanical systems (MEMS) sensor). For example, the vibration sensor 55 may include a 3-axis sensor capable of detecting displacement in three axes (X, Y, Z). As another example, the vibration sensor 55 may include a 6-axis sensor capable of detecting displacement in 6 axes (X, Y, Z, Pitch, Roll, Yaw).

During a washing cycle (e.g., spin-drying process), vibration may occur in the tub 20 due to the rotation of the drum 30. More specifically, eccentricity of the drum 30 may occur due to unbalance of the laundry in the drum 30, and vibration of the tub 20 may occur due to the eccentricity of the drum 30. In a case where a rotational speed of the drum 30 increases while the laundry is unbalanced, the vibration of the tub 20 may increase, and noise may also increase due to the vibration of the tub 20.

The vibration sensor 55 may collect sensor data about the vibration of the tub 20.

For example, the vibration sensor 55 may obtain a vibration value (e.g., acceleration value) corresponding to the vibration of the tub 20.

According to various embodiments, the controller 90 may convert time-domain sensor data output from the vibration sensor 55 to frequency-domain sensor data. For example, the controller 90 may perform Fourier transform on a vibration signal output from the vibration sensor 55, and may convert the vibration signal into a vibration signal in the frequency domain.

To this end, the memory 92 may store instructions for converting the time-domain sensor data output from the vibration sensor 55 to the frequency-domain sensor data, and the processor 91 may convert the time-domain sensor data output from the vibration sensor 55 to the frequency-domain sensor data.

The controller 90 may obtain information about a magnitude of vibration of the tub 20 in the frequency domain, based on processing the vibration signal in the frequency domain.

In one embodiment, the controller 90 may determine whether abnormal vibration has occurred in the tub 20 based on the vibration signal in the time domain. For example, the controller 90 may determine that abnormal vibration has occurred in the tub 20 based on a vibration value in the time domain exceeding a threshold value.

In one embodiment, the controller 90 may determine whether the weight balancer 36 (36; 36*a*, 36*b*) is damaged based on the vibration signal in the frequency domain. The damage to the weight balancer 36 may include the weight balancer 36 which is not properly coupled to the tub 20 (e.g., the fastening bolt is misaligned) and/or a damaged filling member of the weight balancer 36.

Whether the weight balancer 36 is damaged is irrelevant to whether abnormal vibration occurs in the tub 20. Even in a case where the weight balancer 36 is damaged, abnormal vibration may not occur in the tub 20, and even in a case where the weight balancer 36 is not damaged, abnormal vibration may occur in the tub 20. However, in a case where the drum 30 rotates continuously while the weight balancer 36 is damaged and vibration occurs in the tub 20, the damage to the weight balancer 36 may be worsen and a loud noise may be generated, or the washing machine 1 may be damaged.

According to the disclosure, by determining whether the weight balancer 36 is damaged based on the vibration signal in the frequency domain, deterioration of the weight balancer 36 may be prevented in advance even in a case where vibration does not occur in the tub 20.

Furthermore, according to the disclosure, by determining whether the weight balancer 36 is damaged based on the vibration signal in the frequency domain, a cause of vibration in the tub 20 may be more accurately identified.

A specific method of determining whether the weight balancer is damaged based on the vibration signal in the frequency domain will be described later.

According to various embodiments, the sensor portion 95 may further include a motor sensor 40*c* detecting an operation state of the driving device 40.

The motor sensor 40*c* may include, but is not limited to, a current sensor measuring a driving current applied to the motor 41 and/or a torque sensor measuring a torque load of the motor 41.

In one embodiment, the controller 90 may determine whether abnormal vibration occurs in the tub 20 based on an output value of the motor sensor 40*c*.

For example, the controller 90 may determine whether abnormal vibration occurs in the tub 20 based on the driving current applied to the motor 41.

In a case where the driving current applied to the motor 41 exceeds a predetermined value, it may be inferred (assumed) that eccentricity caused by laundry has occurred in the drum 30. In a case where eccentricity occurs due to laundry, abnormal vibration occurs in the tub 20.

The controller 90 may determine that abnormal vibration has occurred in the tub 20 in response to the driving current applied to the motor 41 exceeding the predetermined value.

As another example, the controller 90 may determine whether abnormal vibration occurs in the tub 20 based on a torque of the motor 41.

In a case where the torque of the motor 41 exceeds a predetermined value, it may be inferred that eccentricity due to laundry has occurred in the drum 30. In a case where eccentricity occurs due to laundry, abnormal vibration occurs in the tub 20.

The controller 90 may determine that abnormal vibration has occurred in the tub 20 in response to the torque of the motor 41 exceeding the predetermined value.

The sensor portion 95 is not limited to the above-described examples, and the sensor portion 95 may further include various types of sensors that obtain information related to the operation state of the washing machine 1.

For example, the sensor portion 95 may include at least one of a water level sensor detecting a water level of the tub, a flow rate sensor detecting a flow rate flowing into the tub 20 through the water supply device 50, or a sensor detecting an operation state of the drainage device 70.

For example, the sensor detecting the operation state of the drainage device 70 may include a current sensor measuring a driving current applied to the drain pump 73, but is not limited thereto.

The washing machine 1 may include the communication circuitry 96 for communicating with external devices (e.g., a server, a user device, and/or home appliances) by wire and/or wirelessly.

The communication circuitry 96 may include at least one of a short-range communication module or a long-range communication module.

The communication circuitry 96 may transmit data to an external device or receive data from the external device. For example, the communication circuitry 96 may establish communication with a server, a user device, and/or another home appliance, and transmit and receive various data.

For the communication, the communication circuitry 96 may establish a direct (e.g., wired) communication channel or a wireless communication channel between external devices, and support the performance of the communication through the established communication channel. According to an embodiment, the communication circuitry 96 may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, or a server on a mobile communication network.

In one embodiment, the communication circuitry 96 may communicate with an external device such as a server, a user device, another home appliance, and the like, through an access point (AP). The AP may connect a local area network (LAN), to which the washing machine 1 is connected, to a wide area network (WAN) to which a server is connected. The washing machine 1 may be connected to the server through the wide area network (WAN).

The controller 90 may control various components of the washing machine 1 (e.g., the driving device 40, the water supply device 50, the detergent supply device 60, and the drainage device 70). The controller 90 may control various components of the washing machine 1 to perform at least one process including water supply, washing, rinsing, and/or spin-drying according to user input. For example, the controller 90 may control the motor 41 of the driving device 40 to adjust a rotational speed of the drum 30, control the water supply valve (56*a*, 56*b*) of the water supply device 50 to supply water to the tub 20, control the detergent supply device 60 to supply detergent to the tub 20, or control the drain pump (73*a*, 73*b*) of the drainage device 70 to discharge water from the tub 20 to the outside.

The controller 90 may include hardware, such as a Central Processing Unit (CPU), Micom, or memory, and software such as a control program. For example, the controller 90 may include at least one memory 92 that stores data in the form of a program or an algorithm for controlling operations of components in the washing machine 1, and at least one processor 91 that performs the above-described operations and operations to be described below using the data stored in the at least one memory 92. The memory 92 and the processor 91 may be implemented as separate chips. The processor 91 may include one or two or more processor chips or one or two or more processing cores. The memory 92 may include one or two or more memory chips or one or two or more memory blocks. In addition, the memory 92 and processor 91 may be implemented as a single chip.

The at least one memory 92 may store a cycle profile corresponding to a washing course, operation time of the washing machine, and washing/rinsing/spin-drying settings. The cycle profile may include a rotational speed of the drum 30 during a spin-drying process.

For example, the controller 90 may be mounted on a printed circuit board provided on a rear side of a control panel, which is an example of the user interface device 15.

The controller 90 may be electrically connected to the user interface device 15, the driving device 40, the water supply device 50, the detergent supply device 60, the drainage device 70, the sensor portion 95, and/or the communication circuitry 96.

Figure 8:
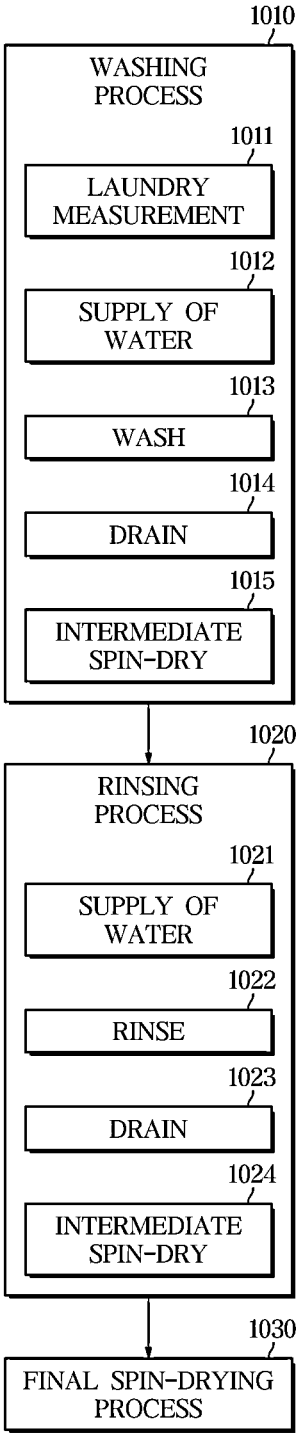
FIG. 8 illustrates an example of a washing cycle of a washing machine according to an embodiment.

FIG. 8 illustrates an example of a washing cycle of a washing machine according to an embodiment.

Referring to FIG. 8, the washing machine 1 may sequentially perform a washing process 1010, a rinsing process 1020, and a spin-drying process 1030 according to a course selected by a user input.

The memory 92 may record/store data including a program for controlling washing operations according to a washing course and washing settings according to the washing course.

The program for controlling the washing operations according to the washing course may include profiles of the washing process 1010, the rinsing process 1020, and/or the final spin-drying process 1030.

The profiles of the washing process 1010, the rinsing process 1020, and/or the final spin-drying process 1030 may include operation profiles of the driving device 40, the water supply device 50, the detergent supply device 60, and/or the drainage device 70. For example, the profiles of the washing process 1010, the rinsing process 1020, and/or the final spin-drying process 1030 may include profiles for a target rotational speed of the drum 30 in spin-drying processes 1015, 1024, and 1030.

The washing process 1010 may include a laundry measurement 1011 for measuring the amount of laundry, a supply of water 1012 for supplying water to the tub 20, a wash 1013 for washing the laundry by rotating the drum 30 at low speed, a drain 1014 for discharging water accommodated in the tub 20, and an intermediate spin-dry 1015 for separating water from the laundry by rotating the drum 30 at high speed.

For the wash 1013, the controller 90 may control the driving device 40 to rotate the motor 41 forward (e.g., clockwise direction) or backward (e.g., counterclockwise direction). By the rotation of the drum 30, the laundry falls from an upper side of the drum 30 to a lower side, and thus the laundry may be washed by falling.

For the intermediate spin-dry 1015, the controller 90 may control the driving device 40 to rotate the motor 41 at high speed. By the high-speed rotation of the drum 30, water may be separated from the laundry accommodated in the drum 30, and thus discharged to the outside of the washing machine 1.

During the intermediate spin-dry 1015, the rotational speed of the drum 30 may be increased gradually.

By the rinsing process 1020, the laundry may be rinsed. Specifically, detergent or foreign substances left in the laundry may be washed away with water.

The rinsing process 1020 may include a supply of water 1021 for supplying water to the tub 20, a rinse 1022 for rinsing the laundry by driving the drum 30, a drain 1023 for discharging the water accommodated in the tub 20, and an intermediate spin-dry 1024 for separating water from the laundry by driving the drum 30.

The supply of water 1021, the drain 1023, and the intermediate spin-dry 1024 of the rinsing process 1020 may be the same as the supply of water 1012, the drain 1014, and intermediate spin-dry 1015 of the washing process 1010, respectively. During the rinsing process 1020, the supply of water 1021, the rinse 1022, the drain 1023, and the intermediate spin-dry 1024 may be performed once or multiple times.

By the final spin-drying process 1030, the laundry may be dehydrated. Specifically, water may be separated from the laundry by the high-speed rotation of the drum 30, and the separated water may be discharged to the outside of the washing machine 1.

The final spin-drying process 1030 may include a final spin-drying in which the drum 30 is rotated at a higher speed than in the intermediate spin-dry 1015 and 1024 to separate water from the laundry. Because of the final spin-dry 1031, the last intermediate spin-dry 1024 of the rinsing process 1020 may be omitted.

For the final spin-drying process 1030, the controller 90 may control the driving device 40 to rotate the motor 41 at high speed. By the high-speed rotation of the drum 30, water may be separated from the laundry accommodated in the drum 30 and discharged to the outside of the washing machine 1. In addition, the rotational speed of the motor 41 may be increased gradually.

Because the operation of the washing machine 1 ends with the final spin-drying process 1030, an operation time of the final spin-drying process 1030 may be longer than that of the intermediate spin-dry 1015 and 1024.

As described above, the washing machine 1 may perform the washing process 1010, the rinsing process 1020, and the final spin-drying process 1030 to wash the laundry. In particular, during the intermediate spin-dry 1015 and 1024 and the final spin-drying process 1030, the washing machine 1 may gradually increase the rotational speed of the motor 41 that rotates the drum 30.

The spin-drying process described throughout the specification may include the intermediate spin-dry 1015 performed in the washing process 1010, the intermediate spin-dry 1024 performed in the rinsing process 1020, and/or the final spin-drying process 1030.

Figure 9:
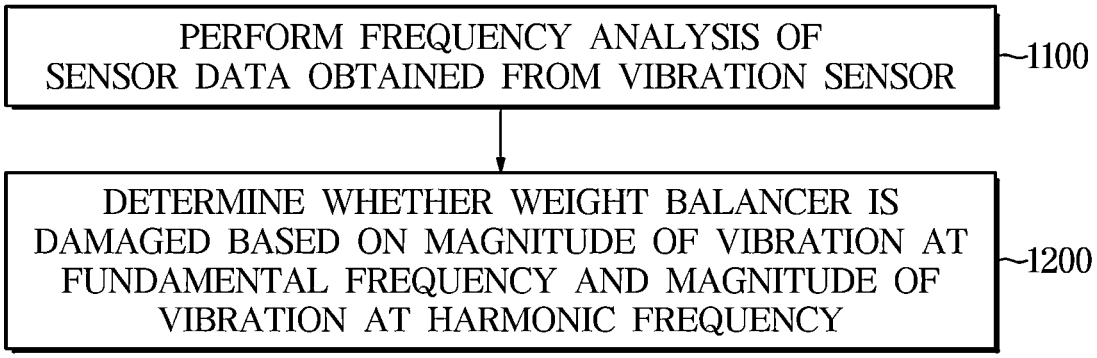
FIG. 9 is a flowchart illustrating an example of a method for controlling a washing machine according to an embodiment.

FIG. 9 is a flowchart illustrating an example of a method for controlling a washing machine according to an embodiment.

Referring to FIG. 9, the controller 90 according to an embodiment may perform frequency analysis on sensor data obtained from the vibration sensor 55 (1100). The sensor data obtained from the vibration sensor 55 may include a magnitude of vibration of the tub 20 in a time domain.

The controller 90 may perform a Discrete Fourier Transform (DFT) or a Fast Fourier Transform (FFT) on a signal corresponding to the magnitude of vibration of the tub 20 in the time domain, thereby calculating a magnitude of vibration of the tub 20 in a frequency domain.

To this end, the memory 92 may store a program for DFT or FFT on the signal corresponding to the magnitude of vibration. The processor 91 may calculate the magnitude of vibration of the tub 20 in the frequency domain by performing a DFT or FFT on the signal obtained from the vibration sensor 55.

Figure 10:
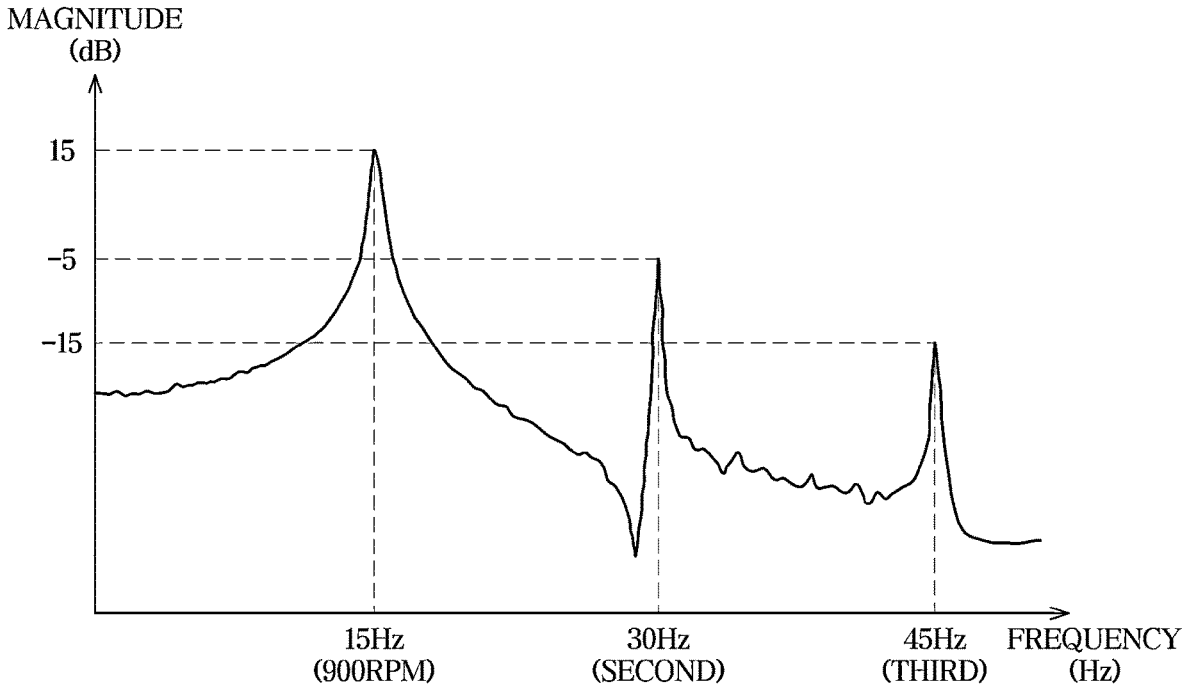
FIG. 10 illustrates an example of a frequency analysis result of sensor data obtained from a vibration sensor according to an embodiment.

FIG. 10 illustrates an example of a frequency analysis result of sensor data obtained from a vibration sensor according to an embodiment.

Referring to FIG. 10, by performing frequency analysis on a signal obtained from the vibration sensor 55, information about a magnitude of vibration in a frequency domain may be obtained.

Vibration may occur in the tub 20 for various reasons, but a main cause of the vibration in the tub 20 may be rotation of the drum 30.

Accordingly, in a case where frequency analysis is performed on the signal obtained from the vibration sensor 55, a magnitude of vibration at a frequency (hereinafter referred to as 'fundamental frequency') corresponding to a rotational speed of the drum 30 may be larger than that of vibration at other frequencies.

The controller 90 may identify the magnitude of vibration at the fundamental frequency corresponding to the rotational speed of the drum 30, and identify a magnitude of vibration at a harmonic frequency of the fundamental frequency. The fundamental frequency continues to change depending on the rotational speed of the drum 30, and the rotational speed of the drum 30 at the time of performing the frequency analysis may be determined as the fundamental frequency.

For example, as shown in FIG. 10, in a case where the rotational speed of the drum 30 is 900 RPM, a magnitude of vibration of the tub 20 at 15 Hz, which is a fundamental frequency corresponding to 900 RPM, is larger than a magnitude of vibration at other frequencies.

That is, a vibration component occurring in the tub 20 as the drum 30 rotates may have a maximum magnitude at the fundamental frequency corresponding to the rotational speed of the drum 30.

In general, in a case where vibration occurs in the tub 20 as the drum 30 rotates, a magnitude of vibration at a harmonic frequency (e.g., 30 Hz, 45 Hz) of the fundamental frequency is significantly smaller than that of the vibration at the fundamental frequency. In the disclosure, the harmonic frequency of the fundamental frequency may refer to the $n^{th}$ order frequency (n is a natural number greater than or equal to 2) of the fundamental frequency.

On the other hand, in a case where abnormal vibration occurs in the tub 20, a magnitude of vibration at the harmonic frequency may increase. However, a magnitude of vibration at the fundamental frequency may also increase, and thus a cause of the abnormal vibration occurring in the tub 20 may not be easily identified.

As will be described later, according to the disclosure, based on the result of performing frequency analysis on the signal obtained from the vibration sensor 55, it may be determined whether a cause of the abnormal vibration occurring in the tub 20 is damage to the weight balancer 36.

Referring back to FIG. 9, the controller 90 may determine whether the weight balancer 36 is damaged based on the magnitude of vibration at the fundamental frequency and the magnitude of vibration at the harmonic frequency (1200).

For example, the controller 90 may determine whether the weight balancer 36 is damaged based on a difference between the magnitude of vibration at the fundamental frequency and the magnitude of vibration at the harmonic frequency.

The damage to the weight balancer 36 may include damage (e.g., cracks, corrosion) to a filling member (e.g., cement/concrete) filled inside the housing, or damage or loosening of a fastening member (e.g., a fastening bolt or nut) connecting the weight balancer 36 and the tub 20.

In a case where the weight balancer 36 is not tightly fixed to the tub 20 due to the damage to the fastening member that couples the weight balancer 36 and the tub 20, or in a case where the filling member of the weight balancer 36 is damaged, the magnitude of vibration of the tub 20 at the harmonic frequency may be increased. For example, in a case where the weight balancer 36 is not tightly fixed to the tub 20 due to the damage to the fastening member that couples the weight balancer 36 and the tub 20, or in a case where the filling member of the weight balancer 36 is damaged, the tub 20 and the weight balancer 36 may continuously collide, causing vibration of harmonic frequency components.

The vibration component of the tub 20 at the fundamental frequency is generated by the rotation of the drum 30, but the vibration of the tub 20 at the harmonic frequency may be generated by causes other than the rotation of the drum 30. Accordingly, if the difference between the magnitude of vibration of the tub 20 at the fundamental frequency and the magnitude of vibration of the tub 20 at the harmonic frequency is not large, it may be strongly inferred that another cause (e.g., damage to the weight balancer 36) other than the rotation of the drum 30 may exist.

On the other hand, in a case where a large vibration occurs in the tub 20, not only the magnitude of vibration of the tub 20 at the fundamental frequency increases, but also the magnitude of vibration of the tub 20 at the harmonic frequency increases. Accordingly, whether the weight balancer 36 is damaged may not be easily determined by using the magnitude of vibration of the tub 20 at the fundamental frequency or the magnitude of vibration of the tub 20 at the harmonic frequency as independent factors. Thus, the controller 90 may determine whether the weight balancer 36 is damaged by using both the magnitude of vibration of the tub 20 at the fundamental frequency and the magnitude of vibration of the tub 20 at the harmonic frequency.

The controller 90 may determine that the weight balancer 36 is damaged based on the difference between the magnitude of vibration of the tub 20 at the fundamental frequency and the magnitude of vibration of the tub 20 at the harmonic frequency being less than a predetermined value.

For example, the controller 90 may determine that the weight balancer 36 is damaged based on a difference between the magnitude of vibration of the tub 20 at the fundamental frequency and a magnitude of vibration of the tub 20 at a second harmonic frequency being less than a first predetermined value.

As another example, the controller 90 may determine that the weight balancer 36 is damaged based on a difference between the magnitude of vibration of the tub 20 at the fundamental frequency and a magnitude of vibration of the tub 20 at a third harmonic frequency being less than a second predetermined value. In this instance, the second predetermined value may be greater than the first predetermined value.

As another example, the controller 90 may determine that the weight balancer 36 is damaged based on a difference between the magnitude of vibration of the tub 20 at the fundamental frequency and a magnitude of vibration of the tub 20 at the $n^{th}$ harmonic frequency being less than a $(n+1)^{th}$ predetermined value.

According to various embodiments, in order to improve the reliability of determining damage to the weight balancer 36, the controller 90 may determine that the weight balancer 36 is damaged, based on a difference between the magnitude of vibration of the tub 20 at the fundamental frequency and a magnitude of vibration of the tub 20 at the $k^{th}$ frequency (k is a natural number greater than or equal to 2) being less than a $(k+1)^{th}$ predetermined value, and a difference between the magnitude of vibration of the tub 20 at the fundamental frequency and a magnitude of vibration of the tub 20 at the $m^{th}$ frequency (m is a natural number different from k and greater than or equal to 2) being less than a $(m+1)^{th}$ predetermined value.

To this end, the memory 92 may store data related to the predetermined values.

The magnitude of vibration in the frequency domain may be expressed in decibel (dB) units, which are log scales. Accordingly, the difference between the magnitude of vibration of the tub 20 at the fundamental frequency and the magnitude of vibration of the tub 20 at the harmonic frequency being less than the predetermined value may include the magnitude of vibration of the tub 20 at the fundamental frequency being a predetermined multiple or less compared to the magnitude of vibration of the tub 20 at the harmonic frequency.

For example, as shown in FIG. 10, in a case where a magnitude of vibration at the fundamental frequency is 15 dB and a magnitude of vibration at the second harmonic frequency is −5 dB, a difference between the magnitude of vibration at the fundamental frequency and the magnitude of vibration at the second harmonic frequency may be defined as 20 dB. In a case where the predetermined value is defined as 22 dB, the controller 90 may determine that the weight balancer 36 is damaged according to the result of the frequency analysis.

As another example, as shown in FIG. 10, in a case where a magnitude of vibration at the fundamental frequency is 15 dB and a magnitude of vibration at the third harmonic frequency is −15 dB, a difference between the magnitude of vibration at the fundamental frequency and the magnitude of vibration at the third harmonic frequency may be defined as 30 dB. In a case where the predetermined value is defined as 35 dB, the controller 90 may determine that the weight balancer 36 is damaged according to the result of the frequency analysis.

In contrast, the controller 90 may determine that the weight balancer 36 is not damaged based on a difference between the magnitude of vibration of the tub 20 at the fundamental frequency and the magnitude of vibration of the tub 20 at the harmonic frequency being greater than or equal to the predetermined value.

According to the disclosure, whether the weight balancer 36 is damaged may be identified early regardless of an absolute magnitude of vibration occurring in the tub 20.

Meanwhile, continuous frequency analysis on the sensor data collected from the vibration sensor 55 may increase a use rate of the processor 91 and memory 92 to process redundant data.

In addition, in order for the result of frequency analysis of the sensor data collected from the vibration sensor 55 to be accurate, a rotational speed of the drum 30 requires to be constant for a predetermined period of time.

According to various embodiments, the controller 90 may perform the operation 1100 of performing frequency analysis on the sensor data collected from the vibration sensor 55 based on a predetermined condition being satisfied, or may perform the operation 1200 of determining whether the weight balancer 36 is damaged based on a predetermined condition being satisfied.

According to the disclosure, the use rate of the processor 91 and the memory 92 may be prevented from unnecessarily increasing. In addition, according to the disclosure, whether the weight balancer 36 is damaged may be more accurately determined by obtaining accurate frequency analysis results.

Figure 11:
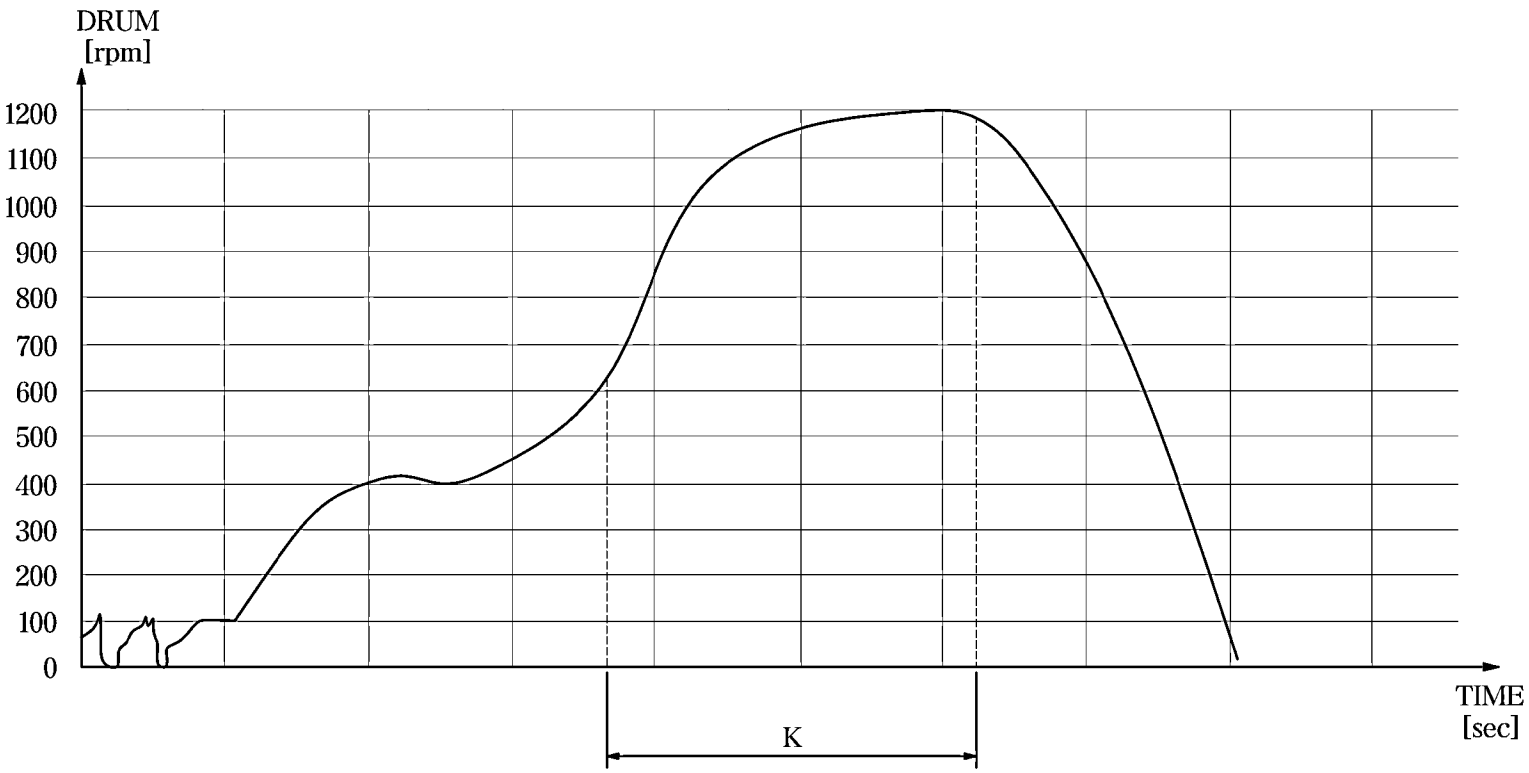
FIG. 11 illustrates an example of a rotational speed profile of a drum in a spin-drying process in a washing machine according to an embodiment.

FIG. 11 illustrates an example of a rotational speed profile of a drum in a spin-drying process in a washing machine according to an embodiment.

Referring to FIG. 11, in an acceleration section K during a spin-drying process, the drum 30 may accelerate to a maximum speed and maintain a rotational speed for a predetermined time after reaching the maximum speed.

The controller 90 may perform an operation of determining whether the weight balancer 36 is damaged based on the rotational speed of the drum 30 reaching a predetermined rotational speed. For example, the controller 90 may determine whether the weight balancer 36 is damaged based on the rotational speed of the drum 30 reaching a maximum rotational speed (e.g., approximately 1200 RPM) in the spin-drying process.

According to the disclosure, by performing frequency analysis on sensor data obtained from the vibration sensor 55 while the rotational speed of the drum 30 is constant, more accurate frequency analysis results may be obtained.

According to various embodiments, the predetermined rotational speed may be defined as another rotational speed other than the maximum rotational speed in the spin-drying process. Preferably, the predetermined rotational speed may be defined as a rotational speed greater than the lowest speed (e.g., approximately 550 RPM) at which vibration components at harmonic frequencies may manifest.

In one embodiment, the controller 90 may control the driving device 40 to maintain the rotational speed of the drum 30 for a predetermined time (e.g., approximately 2 seconds), based on the rotational speed of the drum 30 reaching the predetermined rotational speed. While the rotational speed of the drum 30 is maintained, the controller 90 may perform frequency analysis on the sensor data obtained from the vibration sensor 55, and may determine whether the weight balancer 36 is damaged.

According to the disclosure, whether the weight balancer 36 is damaged may be determined after the drum 30 is maintained at a predetermined rotational speed for a predetermined time before the rotational speed of the drum 30 reaches the maximum rotational speed in the spin-drying process. Accordingly, the damage to the weight balancer 36 may be prevented in advance from worsening due to the acceleration of the drum 30.

Figure 12:
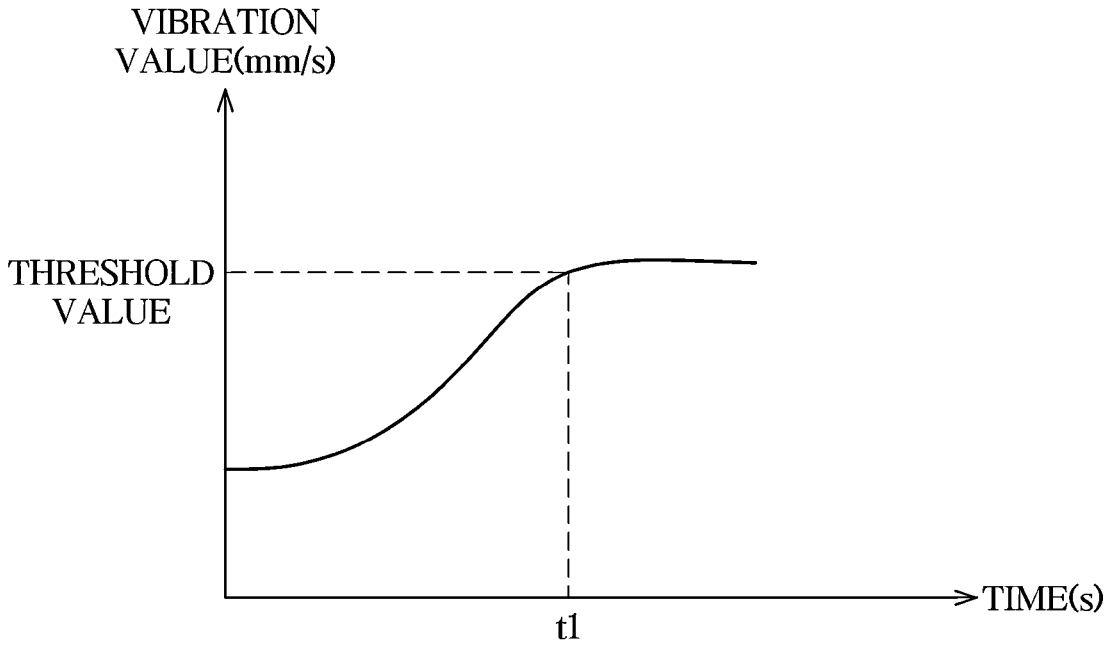
FIG. 12 illustrates an example of sensor data obtained from a vibration sensor according to an embodiment.

FIG. 12 illustrates an example of sensor data obtained from a vibration sensor according to an embodiment.

Referring to FIG. 12, vibration values corresponding to vibration of the tub 20 may be collected by various sensors.

For example, vibration values corresponding to the vibration of the tub 20 may be obtained from the vibration sensor 55 in a time domain. The vibration values obtained from the vibration sensor 55 match the vibration values of the tub 20.

As another example, vibration values corresponding to the vibration of the tub 20 may be obtained from the motor sensor 40*c* in a time domain. The vibration values corresponding to the vibration of the tub 20 from the motor sensor 40*c* may correspond to driving current values applied to the motor 41 and/or torque load values of the motor 41. In this instance, the vibration values corresponding to the vibration of the tub 20 are greater than a threshold value, which may indicate that the driving current values applied to the motor 41 are greater than the threshold value and/or the torque load values of the motor 41 are greater than the threshold value.

A magnitude of vibration value corresponding to the vibration of the tub 20 is absolute and may increase due to various causes. For example, the magnitude of the vibration value may increase due to various causes, such as eccentricity of the drum 30 or damage to the weight balancer 36.

It may not be concluded that the weight balancer 36 is damaged or that eccentricity has occurred in the drum 30 because the magnitude of the vibration value corresponding to the vibration of the tub 20 is large, but it may be strongly inferred that the weight balancer 36 is damaged or that eccentricity has occurred in the drum 30.

The controller 90 may perform frequency analysis on sensor data, obtained from the vibration sensor 55, or determine whether the weight balancer 36 is damaged, based on the vibration value corresponding to the vibration of the tub 20 exceeding the threshold value.

Referring back to FIG. 12, the controller 90 may perform frequency analysis on the sensor data obtained from the vibration sensor 55, or determine whether the weight balancer 36 is damaged at a time point t1 when the vibration value corresponding to the vibration of the tub 20 exceeds the threshold value or at a time point when a predetermined time has elapsed from the time point t1.

To this end, the memory 92 may store data related to the threshold value. The threshold value may be defined in advance as a value at which significant vibration is estimated to have occurred in the tub 20.

According to the disclosure, a use rate of the processor 91 and the memory 92 may be prevented from increasing unnecessarily.

According to the disclosure, in a case where significant vibration occurs in the tub 20, an operation of determining whether the weight balancer 36 is damaged may be performed to identify a cause of the significant vibration.

In one embodiment, the controller 90 may control the driving device 40 to maintain a rotational speed of the drum 30 for a predetermined time (e.g., approximately 2 seconds), based on the vibration value corresponding to the vibration of the tub 20 exceeding the threshold value or based on the rotational speed of the drum 30 reaching a predetermined rotational speed. While the rotational speed of the drum 30 is maintained, the operation of performing frequency analysis on the sensor data and the operation of determining whether the weight balancer 36 is damaged may be performed.

According to the disclosure, in a case where vibration occurs in the tub 20, whether the cause of the vibration is damage to the weight balancer 36 may be determined more accurately and quickly.

Figure 13:
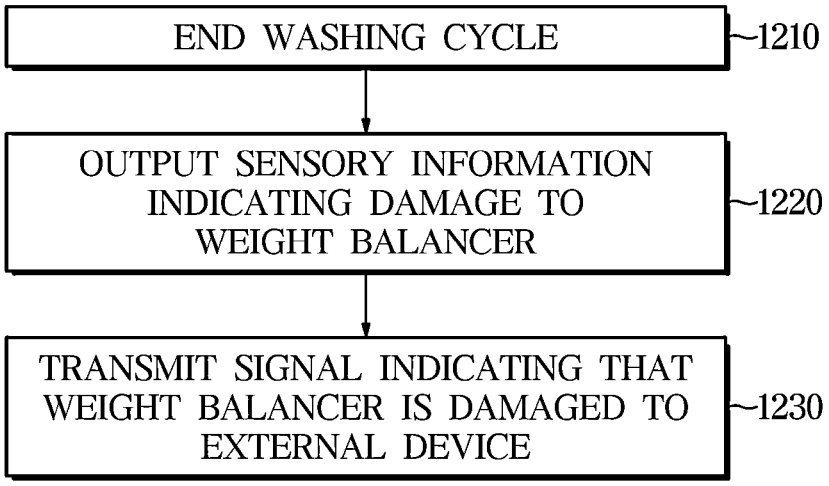
FIG. 13 is a flowchart illustrating an example of a method for controlling a washing machine according to an embodiment in a case where a weight balancer is determined to be damaged.

FIG. 13 is a flowchart illustrating an example of a method for controlling a washing machine according to an embodiment in a case where a weight balancer is determined to be damaged.

The controller 90 may perform at least one of operations 1210, 1220, or 1230 shown in FIG. 13, based on determining that the weight balancer 36 is damaged.

Referring to FIG. 13, the washing machine 1 may end a washing cycle based on determining that the weight balancer 36 is damaged (1210). For example, the controller 90 may control various components of the washing machine 1 (e.g., the driving device 40, the water supply device 50, the detergent supply device 60, the drainage device 70) to end the washing cycle based on determining that the water balancer is damaged.

Ending the washing cycle may include stopping the drum 30.

For example, the controller 90 may stop the drum 30 based on determining that the weight balancer 36 is damaged.

Ending the washing cycle may refer to omitting any subsequent processes to be performed from the processes shown in FIG. 8 and ending the washing cycle.

For example, in a case where the weight balancer 36 is determined to be damaged during the intermediate spin-dry 1015 in the washing process 1010, the controller 90 may skip the rinsing process 1020 and the final spin-drying process 1030 and immediately end the washing cycle.

As another example, in a case where the weight balancer 36 is determined to be damaged during the intermediate spin-dry 1024 in the rinsing process 1020, the controller 90 may skip the final spin-drying process 1030 and immediately end the washing cycle.

According to the disclosure, deterioration of the weight balancer 36 or damage to the washing machine 1 may be prevented in advance by ending the washing cycle immediately after determining that the weight balancer 36 is damaged.

In one embodiment, based on determining that the weight balancer 36 is damaged, the controller 90 may only perform processes other than processes in which the drum 30 is to be rotated above a predetermined rotational speed (e.g., the spin-drying processes 1015, 1024, and 1030).

For example, in a case where the weight balancer 36 is determined to be damaged during the intermediate spin-dry 1015 in the washing process 1010, the controller 90 may perform the supply of water 1021, the rinse 1022, and the drain 1023 at least once by omitting the intermediate spin-dry 1024 in the rinsing process 1020 and the final spin-drying process 1030.

According to the disclosure, user convenience may be achieved by performing the remaining processes other than the spin-drying process, without worsening a condition of the weight balancer 36.

Figure 14:
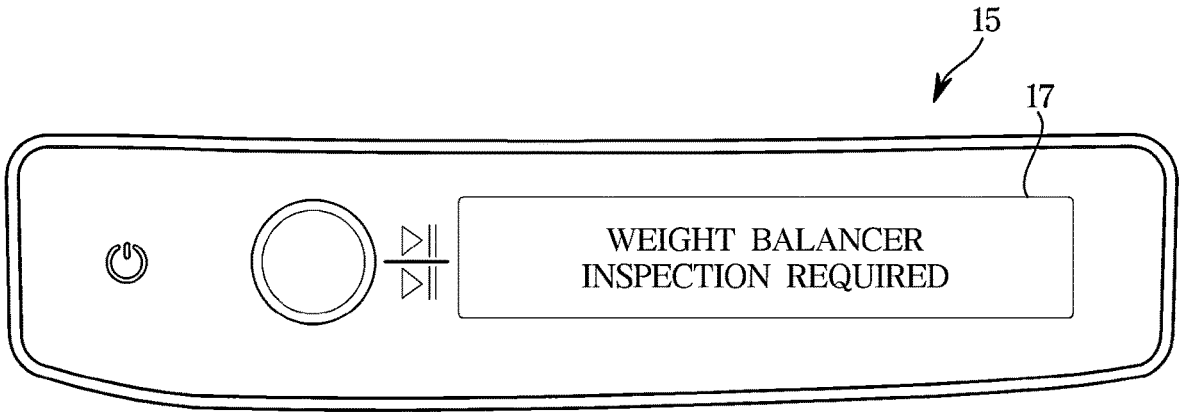
FIG. 14 illustrates an example where sensory information indicating a damage to a weight balancer is output by a washing machine according to an embodiment.

FIG. 14 illustrates an example where sensory information indicating a damage to a weight balancer is output by a washing machine according to an embodiment.

Referring to FIG. 14, the washing machine 1 may output sensory information indicating damage to the weight balancer 36 based on determining that the weight balancer 36 is damaged (1220).

For example, the controller 90 may control the user interface device 15 (e.g., the output interface 17) to output the sensory information indicating damage to the weight balancer 36 based on determining that the weight balancer 36 is damaged.

For example, the output interface 17 may include a Liquid Crystal Display (LCD) panel, a Light Emitting Diode (LED) panel, a speaker, and the like. The sensory information indicating damage to the weight balancer 36 may include, for example, an image, animation, text, figure, sound, voice, and the like. The sensory information indicating damage to the weight balancer 36 may be information for requesting inspection of the weight balancer 36.

The output interface 17 (e.g., a display) may provide the sensory information indicating damage to the weight balancer 36, based on a control signal from the controller 90.

For example, as shown in FIG. 14, the output interface 17 may output text indicating that the weight balancer 36 is damaged. However, the sensory information indicating damage to the weight balancer 36 is not limited thereto.

As another example, the output interface 17 (e.g., a speaker) may output a sound indicating that the weight balancer 36 is damaged.

According to the disclosure, a user may recognize an abnormality in the weight balancer 36 and take immediate action, thereby preventing an occurrence of a loud noise due to the damage to the weight balancer 36. In addition, the user may recognize the abnormality in the weight balancer 36 and take immediate action, thereby preventing a risk of damage to the washing machine 1 due to damage to the weight balancer 36.

Figure 15:
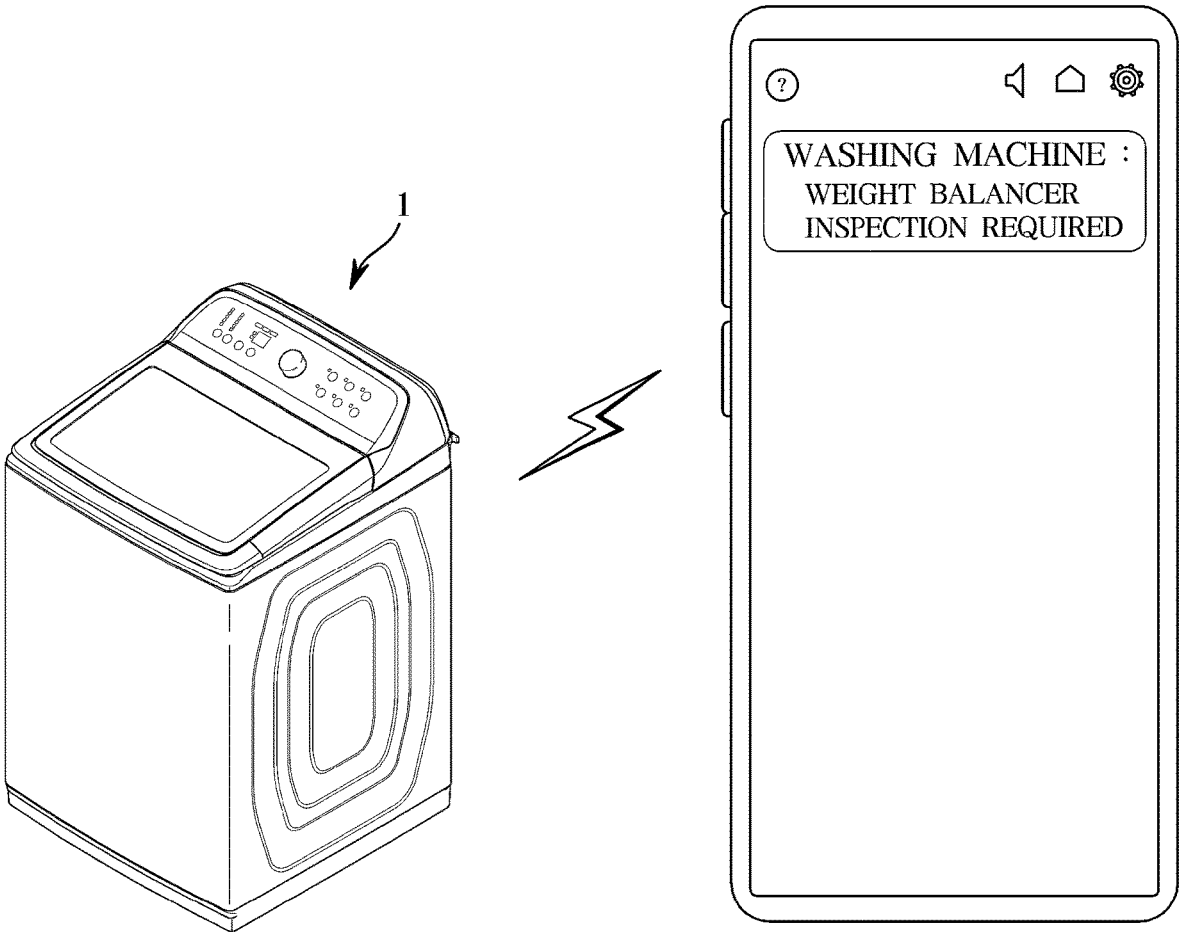
FIG. 15 illustrates an example where a signal for indicating a damage to a weight balancer is transmitted to an external device from a washing machine according to an embodiment.

FIG. 15 illustrates an example where a signal for indicating a damage to a weight balancer is transmitted to an external device from a washing machine according to an embodiment.

Referring to FIG. 15, the washing machine 1 may transmit a signal indicating damage to the weight balancer 36 to an external device 2 (1230).

The controller 90 may control the communication circuitry 96 to transmit the signal indicating damage to the weight balancer 36 to the external device, based on determining that the weight balancer 36 is damaged.

The external device may include a server, a user device (e.g., a smartphone), other home appliances, and the like.

For example, the signal indicating damage to the weight balancer 36 may be transmitted to a user device owned by a user of the washing machine 1 via a server.

Based on receiving the signal indicating damage to the weight balancer 36, the external device may output sensory information (e.g., image, vibration, sound, etc.) indicating damage to the weight balancer 36 through an output interface of the external device.

For example, in a case where the external device is a smartphone, the smartphone may output a notification message, vibration, and/or sound based on receiving the signal indicating damage to the weight balancer 36.

According to the disclosure, a user may recognize an abnormality in the weight balancer 36 and take immediate action.

Various embodiments of the disclosure and terms used therein are not intended to limit the technical features described in the disclosure to particular embodiments, and it should be construed as including various modifications, equivalents, or alternatives of a corresponding embodiment.

According to an embodiment of the disclosure, a washing machine 1 may include: a tub 20; a drum 30 configured to be rotatable inside the tub 20; a weight balancer 36 configured to be coupled to the tub 20; a vibration sensor 55 configured to detect vibration of the tub 20; and at least one processor 91 configured to determine whether the weight balancer 36 is damaged based on a difference between a magnitude of the vibration at a fundamental frequency corresponding to a rotational speed of the drum 30 and a magnitude of the vibration at a harmonic frequency of the fundamental frequency.

In addition, the at least one processor 91 may be configured to determine that the weight balancer 36 is damaged, based on the difference between the magnitude of the vibration at the fundamental frequency and the magnitude of the vibration at the harmonic frequency being less than a predetermined value.

In addition, the at least one processor 91 may be configured to perform an operation of determining whether the weight balancer 36 is damaged, based on the rotational speed of the drum 30 reaching a predetermined rotational speed.

In addition, the predetermined rotational speed may correspond to a maximum rotational speed in a spin-drying process.

In addition, the at least one processor 91 may be configured to perform an operation of determining whether the weight balancer 36 is damaged, based on a vibration value corresponding to the vibration of the tub exceeding a threshold value.

In addition, the harmonic frequency may be a second harmonic frequency.

In addition, the at least one processor 91 may be configured to control an output interface to output sensory information indicating that the weight balancer 36 is damaged, based on determining that the weight balancer 36 is damaged.

In addition, the at least one processor 91 may be configured to stop the drum 30, based on determining that the weight balancer 36 is damaged.

In addition, the at least one processor 91 may be configured to end a washing cycle, based on determining that the weight balancer 36 is damaged.

In addition, the at least one processor 91 may be configured to control a communication circuitry to transmit a signal for indicating that the weight balancer 36 is damaged to an external device, based on determining that the weight balancer 36 is damaged.

According to an embodiment of the disclosure, a method for controlling a washing machine 1 including a vibration sensor 55 configured to detect vibration of a tub 20 may include: determining whether a weight balancer 36 coupled to the tub 20 is damaged, based on a difference between a magnitude of the vibration at a fundamental frequency corresponding to a rotational speed of a drum 30 and a magnitude of the vibration at a harmonic frequency of the fundamental frequency.

In addition, the determining of whether the weight balancer 36 is damaged may include determining that the weight balancer 36 is damaged, based on the difference between the magnitude of the vibration at the fundamental frequency and the magnitude of the vibration at the harmonic frequency being less than a predetermined value.

In addition, the determining of whether the weight balancer 36 is damaged may be performed based on the rotational speed of the drum 30 reaching a predetermined rotational speed In addition, the predetermined rotational speed may correspond to a maximum rotational speed in a spin-drying process.

In addition, the determining of whether the weight balancer 36 is damaged may be performed based on a vibration value corresponding to the vibration of the tub exceeding a threshold value.

In addition, the harmonic frequency may be a second harmonic frequency.

In addition, the method for controlling the washing machine 1 may further include: outputting sensory information indicating that the weight balancer 36 is damaged, based on determining that the weight balancer 36 is damaged.

In addition, the method for controlling the washing machine 1 may further include: stopping the drum 30, based on determining that the weight balancer 36 is damaged.

In addition, the method for controlling the washing machine 1 may further include: ending a washing cycle, based on determining that the weight balancer 36 is damaged.

In addition, the method for controlling the washing machine 1 may further include: transmitting a signal for indicating that the weight balancer 36 is damaged to an external device, based on determining that the weight balancer 36 is damaged.

The disclosed embodiments may be implemented in the form of a recording medium that stores instructions executable by a computer. The instructions may be stored in the form of program codes, and when executed by a processor, the instructions may create a program module to perform operations of the disclosed embodiments.

The computer-readable recording medium may include all kinds of recording media storing instructions that may be interpreted by a computer. For example, the computer-readable recording medium may be a Read Only Memory (ROM), a Random Access Memory (RAM), a magnetic tape, a magnetic disk, a flash memory, an optical data storage device, etc.

The computer-readable storage medium may be provided in the form of a non-transitory storage medium. Here, when a storage medium is referred to as "non-transitory", it may be understood that the storage medium is tangible and does not include a signal (e.g., an electromagnetic wave), but rather that data is semi-permanently or temporarily stored in the storage medium. For example, a "non-transitory storage medium" may include a buffer in which data is temporarily stored.

According to an embodiment, the method according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed (e.g., download or upload) through an application store (e.g., Play Store™) online or directly between two user devices (e.g., smartphones). In the case of online distribution, at least a portion of the computer program product (e.g., downloadable app) may be stored at least semi-permanently or may be temporarily generated in a storage medium, such as a memory of a server of a manufacturer, a server of an application store, or a relay server.

Although disclosure has been shown and described in relation to specific embodiments, it would be appreciated by those skilled in the art that changes and modifications may be made in these embodiments without departing from the principles and scope of the disclosure, the scope of which is defined in the claims and their equivalents.

What is claimed is:

1. A washing machine, comprising:

a tub;

a drum configured to be rotatable inside the tub;

a weight balancer coupled to the tub;

a vibration sensor configured to detect vibration of the tub while the drum is rotating; and at least one processor configured to determine whether the weight balancer is damaged based on a difference between a magnitude of the detected vibration at a fundamental frequency corresponding to a rotational speed of the drum and a magnitude of the detected vibration at a harmonic frequency of the fundamental frequency.

2. The washing machine of claim 1, wherein the at least one processor is configured to determine that the weight balancer is damaged, based on the difference between the magnitude of the vibration at the fundamental frequency and the magnitude of the vibration at the harmonic frequency being less than a predetermined value.

3. The washing machine of claim 1, wherein the at least one processor is configured to perform an operation of determining whether the weight balancer is damaged, based on the rotational speed of the drum reaching a predetermined rotational speed.

4. The washing machine of claim 3, wherein the predetermined rotational speed corresponds to a maximum rotational speed in a spin-drying process.

5. The washing machine of claim 1, wherein the at least one processor is configured to perform an operation of determining whether the weight balancer is damaged, based on a vibration value corresponding to the vibration of the tub exceeding a threshold value.

6. The washing machine of claim 1, wherein the harmonic frequency is a second harmonic frequency of the fundamental frequency, and the at least one processor is configured to determine whether the weight balancer is damaged based on a difference between the magnitude of the detected vibration at the fundamental frequency and a magnitude of the detected vibration at the second harmonic frequency.

7. The washing machine of claim 1, further comprising:

an output interface; and wherein the at least one processor is configured to control the output interface to output sensory information indicating that the weight balancer is damaged, based on determining that the weight balancer is damaged.

8. The washing machine of claim 1, wherein the at least one processor is configured to stop the drum, based on determining that the weight balancer is damaged.

9. The washing machine of claim 1, wherein the at least one processor is configured to end a washing cycle, based on determining that the weight balancer is damaged.

10. The washing machine of claim 1, further comprising:

a communication circuitry configured to communicate with an external device, wherein the at least one processor is configured to control the communication circuitry to transmit a signal to indicate that the weight balancer is damaged to the external device, based on determining that the weight balancer is damaged.

11. A method for controlling a washing machine comprising a tub, a drum configured to be rotatable inside the tub, a weight balancer coupled to the tub, and a vibration sensor configured to detect vibration of the tub, the method comprising:

detecting vibration of the tub by the vibration sensor while the drum is rotating;

determining whether the weight balancer is damaged, based on a difference between a magnitude of the detected vibration at a fundamental frequency corresponding to a rotational speed of the drum and a magnitude of the detected vibration at a harmonic frequency of the fundamental frequency.

12. The method of claim 11, wherein the determining of whether the weight balancer is damaged comprises determining that the weight balancer is damaged based on the difference between the magnitude of the vibration at the fundamental frequency and the magnitude of the vibration at the harmonic frequency being less than a predetermined value.

13. The method of claim 11, wherein the determining of whether the weight balancer is damaged is performed based on the rotational speed of the drum reaching a predetermined rotational speed.

14. The method of claim 13, wherein the predetermined rotational speed corresponds to a maximum rotational speed in a spin-drying process.

15. The method of claim 11, wherein the determining of whether the weight balancer is damaged is performed based on a vibration value corresponding to the vibration of the tub exceeding a threshold value.

* * * * *